US010316277B2

(12) United States Patent
Watson

(10) Patent No.: US 10,316,277 B2
(45) Date of Patent: Jun. 11, 2019

(54) HIGH PERFORMANCE LAUNDRY POWDER UNIT DOSE AND METHODS OF MAKING THE SAME

(71) Applicant: Korex Canada Company, Etobicoke (CA)

(72) Inventor: Douglas Robert Watson, Toronto (CA)

(73) Assignee: KOREX CANADA COMPANY, Etobicoke, Ontario (CA)

( * ) Notice: Subject to any disclaimer, the term of this patent is extended or adjusted under 35 U.S.C. 154(b) by 145 days.

(21) Appl. No.: 15/383,370

(22) Filed: Dec. 19, 2016

(65) Prior Publication Data

US 2017/0175056 A1 Jun. 22, 2017

Related U.S. Application Data

(60) Provisional application No. 62/269,578, filed on Dec. 18, 2015.

(51) Int. Cl.

| | |
|---|---|
| ***C11D 17/04*** | (2006.01) |
| ***C11D 3/386*** | (2006.01) |
| ***C11D 3/39*** | (2006.01) |

(52) U.S. Cl.

CPC ..... *C11D 17/042* (2013.01); *C11D 3/38672* (2013.01); *C11D 3/3915* (2013.01); *C11D 3/3917* (2013.01); *C11D 17/044* (2013.01)

(58) Field of Classification Search

None

See application file for complete search history.

(56) References Cited

U.S. PATENT DOCUMENTS

| | | | | |
|---|---|---|---|---|
| 4,265,790 | A | 5/1981 | Winston et al. | |
| 4,427,417 | A | 1/1984 | Porasik | |
| 4,728,455 | A | 3/1988 | Rerek | |
| 4,876,023 | A * | 10/1989 | Dickenson | C11D 17/046 206/5 |
| 4,891,160 | A | 1/1990 | Vander Meer | |
| 5,080,848 | A | 1/1992 | Strauss | |
| 5,152,932 | A | 10/1992 | Mueller | |
| 5,198,145 | A | 3/1993 | Lobunez | |
| 5,468,411 | A * | 11/1995 | Dixit | C11D 3/046 435/219 |

(Continued)

OTHER PUBLICATIONS

Grohmann, "Hygiene Effects of Bleach Systems in Laundry Detergents"; SOFW Journal; Oct. 2011; pp. 1-7.

Italmatch Chemicals, Introductory Brochure, DEQUEST, p. 1-18.

*Primary Examiner* — Lorna M Douyon

(74) *Attorney, Agent, or Firm* — Dinsmore & Shohl LLP

(57) ABSTRACT

A unit dose laundry composition includes from 1 wt. % to 10 wt. % of one or more coated enzymes, from 1 wt. % to 40 wt. % of a bleach composition comprising an oxidizing agent and one or more bleach activators, from 15 wt. % to 80 wt. % of a surfactant composition, and one or more of an alkaline compound, a detergent builder, a chelant, or a polymer composition. The unit dose laundry composition is in the form of a powder, which has a bulk density of from 500 g/L to 1300 g/L, encapsulated a polymer film. A method of making the unit dose laundry composition includes combining one or more liquid active components with one or more high absorbing solid active components to produce a powder intermediate which may be blended with other solid components.

19 Claims, 1 Drawing Sheet

(56) References Cited

U.S. PATENT DOCUMENTS

| | | | | |
|---|---|---|---|---|
| 5,534,178 | A * | 7/1996 | Bailly | C11D 17/044 510/224 |
| 5,693,602 | A * | 12/1997 | Draiper | C11D 3/08 510/224 |
| 5,807,817 | A | 9/1998 | Mazzola et al. | |
| 5,914,307 | A | 6/1999 | DeNome et al. | |
| 6,204,234 | B1 * | 3/2001 | Herbots | C11D 3/38654 510/130 |
| 6,680,288 | B1 | 1/2004 | Groot | |
| 6,818,605 | B1 | 11/2004 | Ban et al. | |
| 2002/0137648 | A1 * | 9/2002 | Sharma | A47L 15/44 510/218 |
| 2002/0169092 | A1 * | 11/2002 | Alexandre Catlin | B65B 9/04 510/220 |
| 2003/0092595 | A1 * | 5/2003 | Romero | C11D 17/0039 510/447 |
| 2010/0190677 | A1 * | 7/2010 | Esposito | C11D 3/3761 510/296 |

* cited by examiner

HIGH PERFORMANCE LAUNDRY POWDER UNIT DOSE AND METHODS OF MAKING THE SAME

CROSS-REFERENCE TO RELATED APPLICATIONS

This application claims priority to U.S. Provisional Application No. 62/269,578, filed Dec. 18, 2015, which is incorporated by reference herein in its entirety.

TECHNICAL FIELD

Embodiments of the present disclosure generally relate to laundry compositions, in particular powder laundry compositions in unit doses and methods of making the powder laundry compositions.

BACKGROUND

The laundry detergent market in the United States has moved more towards liquid detergent formulations, including introduction of unit doses of liquid detergents contained within thin polymer film pouches. The liquid products rely on surfactants, enzymes, and small amounts of chelants and detersive and/or multifunctional polymers. These liquid products are intended to be fully formulated unit dose products, but are not formulated to accomplish oxidation reactions in the washing machine and do not have sufficient calcium and magnesium ion control mechanisms for enhanced detergency in hard water. Often secondary laundry compositions, such as products marketed as oxy boosters, must be used in conjunction with the liquid products to accomplish high performance laundry washing. There are numerous powdered laundry products and machine cleaners, in unit dose powder format, on the market. However, these products do not incorporate a blend of functional chemical properties in a single unit dose application in sufficient concentration to perform as a stand-alone high performance detergent product.

SUMMARY

There is a need for a powdered unit dose laundry composition that includes a mixture of functional compounds in sufficient concentration to perform as a stand-alone high performance detergent product. Embodiments of the present disclosure are directed to powdered unit dose laundry compositions that include multiple functional compounds encapsulated in a polymer film.

According to one or more aspects, a unit dose laundry composition comprises a laundry composition that includes from 1 wt. % to 10 wt. % of one or more coated enzymes, from 1 wt. % to 40 wt. % of a bleach composition comprising an oxidizing agent and one or more bleach activators, from 15 wt. % to 80 wt. % of a surfactant composition, and one or more of an alkaline compound, a detergent builder, a chelant, or a polymer composition. The laundry composition is a powder having a bulk density of from 500 grams per liter to 1,300 grams per liter. The laundry composition is substantially free of fillers. The unit dose laundry composition also includes a polymer film encapsulating the laundry composition.

In another aspect, a unit dose laundry composition comprises a laundry composition encapsulated in a polymer film, the laundry composition comprising from 1 wt. % to 10 wt. % of one or more coated enzymes, from 1 wt. % to 40 wt. % of a bleach composition comprising an oxidizing agent and one or more bleach activators, from 15 wt. % to 80 wt. % of a surfactant composition, from 5 wt. % to 50 wt. % of an alkaline compound, from 10 wt. % to 50 wt. % of a detergent builder, from 0.5 wt. % to 20 wt. % of a chelant, and from 1 wt. % to 20 wt. % of a detersive polymer. The laundry composition is a powder.

Additional features and advantages of the described embodiments will be set forth in the detailed description which follows, and in part will be readily apparent to those skilled in the art from that description or recognized by practicing the described embodiments, including the detailed description which follows and the claims.

BRIEF DESCRIPTION OF THE DRAWINGS

The following detailed description of specific embodiments of the present disclosure can be best understood when read in conjunction with the following drawings, where like structure is indicated with like reference numerals and in which.

Figure 1:
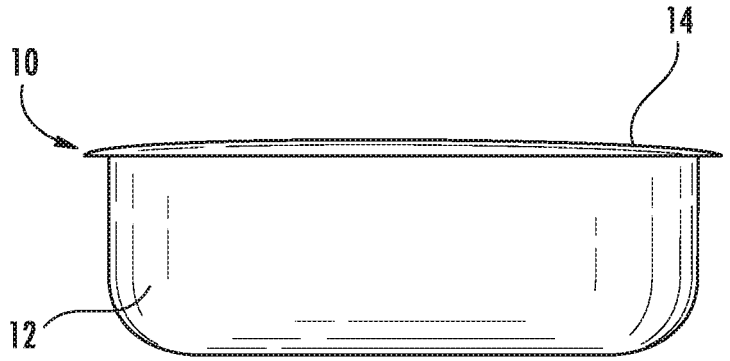
FIG. 1 schematically depicts a side view of a laundry composition unit dose, in accordance with one or more embodiments of the present disclosure.

Additional features and advantages of the described embodiments will be set forth in the detailed description which follows, and in part will be readily apparent to those skilled in the art from that description or recognized by practicing the described embodiments, including the detailed description which follows and the claims.

DETAILED DESCRIPTION

Embodiments of the present disclosure are directed to high performance laundry compositions formulated into a powder unit dose and methods of making the high performance laundry powder compositions. In an embodiment, a unit dose laundry composition comprises a laundry composition encapsulated in a polymer film. The laundry composition includes one or more coated enzymes, a bleach composition, a surfactant composition, and one or more of an alkaline compound, a detergent builder, a chelant, or a polymer composition. The bleach composition may include a bleaching agent and an activator. The laundry composition is a powder that is encapsulated in a polymer film and that has a packed density of 500 grams per liter (g/L) to 1,300 g/L in some embodiments, from 600 g/L to 1,000 g/L in other embodiments, or from 650 g/L to 1,000 g/L is still other embodiments. Methods of making the laundry composition are also disclosed. The unit dose laundry compositions disclosed herein are high performance powder laundry detergent compositions that combine a plurality of key functional detergent ingredients in sufficient concentration, and at a suitable density, to provide a unit dose product that has exhibits enhanced laundry cleaning performance across a broad range of water temperatures and hardness.

Several cleaning mechanisms have been identified for laundry and other detergent compositions. These cleaning mechanisms include at least the following seven key mechanisms: enzymatic action, oxidation, surfactants, alkaline neutralization of fatty acids, detergent building, chelation, and detersive polymers. Enzymatic action utilizes one or more enzymes to facilitate removal of a wide range of soils, including but not limited to protein, starch, polysaccharide, and triglyceride materials from a fabric or substrate. Oxidation utilizes an oxidizing agent in combination with at least one of a bleaching activator, bleaching catalyst, or combinations of bleach activators and/or bleach catalysts to provide bleaching, whitening, and disinfecting fabrics and the washing machine as well as providing additional stain removal. Surfactants, including both anionic and nonionic surfactants, facilitate removal of particulate matter and oily soil from fabrics. Alkaline compounds may be included in a laundry composition for neutralizing fatty acids. Detergent builders and other bivalent metal ion control agents facilitate calcium and magnesium ion precipitation, sequestration, chelation, and/or ion-exchange. Chelation with a strong metal ion chelant provides water soluble chelation, improved bleaching stability, and assistance in removal of specific stains. Detersive polymers with anionic or nonionic character may be used for soil removal, calcium carbonate crystal control inhibition, and anti-redeposition, as well as other benefits.

None of the conventional laundry powder detergents known provide a high performance powder product that combines all of the seven cleaning mechanisms previously discussed in sufficient concentration, and at a suitable density, to provide a compact unit dose product that has high performance across water temperatures and hardness. For example, conventional powdered laundry detergents or active oxygen booster powders in unit dose format may include an oxidizing agent but very low concentrations of surfactants, which results in underperformance in soil removal. Formulators in the detergent industry have moved towards liquid detergents and liquid detergent unit dose compositions. However, these liquid detergent unit dose compositions presently on the market rely heavily on surfactants and enzymes, with limited quantities of chelants and detersive polymers and no oxidizing agents. The existing liquid detergent unit dose compositions are expensive to produce and do not provide oxidation of soils, biocidal activity, or odor control. Multiple-compartment unit doses with liquid compartments and powder compartments may overcome this limitation but manufacturing these multiple-compartment unit doses requires more specialized equipment. Additionally, the liquid phase portion of the multiple-compartment unit dose would require at least a solubilizing agent, which does not add detergency and increases formulation costs. Encapsulation of bleach granules suspended in a liquid phase unit dose is another solution to the deficiencies in conventional laundry unit doses, but the cost to manufacture the encapsulated bleach granules is substantial and the risks of encapsulation breakage during handling and processing of the liquid suspension are great. Thus, there is a need for improved powdered unit dose laundry compositions.

Unit dose laundry compositions discussed herein include functional ingredients from each of the seven cleaning mechanisms in sufficient concentration and at a suitable density to provide a unit dose product that exhibits enhanced soil removal performance across a broad range of water temperatures and water hardness. As discussed above, the unit dose laundry compositions include coated enzymes, a bleach composition, a surfactant composition, and at least one of an alkaline compound, a detergent builder, a chelant, or a detersive polymer. In some embodiments, the unit dose laundry composition includes the alkaline compound, detergent builder, chelant, and at least a detersive polymer. As subsequently discussed, the unit dose laundry composition, which is in the form of a powdered laundry composition encapsulated in a polymer film, provides enhanced soil removal from fabrics that is comparable to market-leading multiple-compartment liquid unit dose formulations. The unit dose laundry composition is more cost-effective to produce than the multiple-compartment liquid unit dose formulations and may also provide oxidation, biocidal activity, and odor-reduction benefits that are not provided by the market-leading multiple-compartment liquid detergent unit dose formulations. Various embodiments of each of the components of the laundry composition will now be discussed in further detail.

Enzyme Composition

The laundry composition includes an enzyme composition comprising one or more enzymes which facilitate removal of a broad range of protein, starch, polysaccharide, and triglyceride materials from a substrate, such as a fabric. Enzymes are globular proteins generally comprising a linear chain of amino acids that is folded in on itself to produce a three-dimensional structure. The enzymes catalyze reactions that result in the conversion of large organic molecules of proteins, carbohydrates, polysaccharides, triglycerides, starches, and other organic matter into smaller molecules, which may be more water-soluble or more easily removed by one or more of the other active ingredients in a laundry composition.

The enzymatic activity of the enzyme compositions used in the laundry unit-dose composition is broad based in order to cover a broad range of laundry stains, which may include materials such as protein, carbohydrate, triglycerides. The enzyme composition of the laundry composition may include one or more hydrolase enzymes. Hydrolase enzymes are enzymes that catalyze the hydrolysis of chemical bonds, which results in cleavage of larger molecules of stains and soils into smaller molecules. Example hydrolase enzymes may include, but are not limited to protease, amylase, mannanase, lipase, pectinase, or other hydrolase enzymes. The enzyme composition may also optionally include cellulase enzymes, which may be used for fabric texturing benefits, or xyloglucanase enzymes. Cellulases added to the laundry composition may also provide enhanced color brightness to colored fabrics washed with the laundry composition. Other specialty enzymes having specific functionality may also be included in the laundry composition. For example, specialty enzymes may include, but are not limited to, xyloglucanase enzymes or oxidoreductase enzymes.

Enzymes used in the enzyme composition are preferably provided in a solid form, examples of which include, but are not limited to granules, powders, or other particulate solids for example. In solid or powder form, high concentrations of mixed enzymes can be used without sacrificing stability of the enzymes. In some example enzyme compositions, one or more of the enzymes of the enzyme composition may be a granular coated enzyme, which may operate more effectively in cold water. An example of a granular coated enzyme suitable for cold water applications includes, but is not limited to POLARZYME® brand protease enzyme manufactured by Novozymes. Other coated enzymes are contemplated.

The laundry composition includes a weight percent of the enzyme composition of from 0.5 wt. % to 20 wt. %, from 0.5 wt. % to 15 wt. %, from 0.5 wt. % to 10 wt. %, from 0.5 wt. % to 5 wt. %, from 1 wt. % to 20 wt. %, from 1 wt. % to 15 wt. %, from 1 wt. % to 10 wt. %, from 1 wt. % to 5 wt. %, from 2 wt. % to 20 wt. %, from 2 wt. % to 15 wt. %, from 2 wt. % to 10 wt. %, from 2 wt. % to 5 wt. %, from 5 wt. % to 20 wt. %, from 5 wt. % to 15 wt. %, from 5 wt. % to 10 wt. %, from 10 wt. % to 20 wt. %, from 10 wt. % to 15 wt. %, or from 15 wt. % to 20 wt. %, based on the total weight of the laundry composition.

In embodiments, the enzyme composition may include a plurality of different enzymes. In some embodiments, the enzyme composition may include at least one of protease, amylase, mannanase, lipase, pectinase, cellulose, or combinations of these enzymes. In embodiments, the laundry composition may include a weight percent of protease of from 0.1 wt. % to 7 wt. %, from 0.1 wt. % to 5 wt. %, from 0.1 wt. % to 3 wt. %, from 1 wt. % to 7 wt. %, from 1 wt. % to 5 wt. %, from 1 wt. % to 3 wt. %, from 2 wt. % to 7 wt. %, from 2 wt. % to 5 wt. %, from 3 wt. % to 7 wt. %, or from 3 wt. % to 5 wt. % based on the total weight of the laundry composition. In embodiments, the laundry composition may include a weight percent of amylase of from 0.1 wt. % to 7 wt. %, from 0.1 wt. % to 5 wt. %, from 0.1 wt. % to 3 wt. %, from 1 wt. % to 7 wt. %, from 1 wt. % to 5 wt. %, from 1 wt. % to 3 wt. %, from 2 wt. % to 7 wt. %, from 2 wt. % to 5 wt. %, from 3 wt. % to 7 wt. %, or from 3 wt. % to 5 wt. % based on the total weight of the laundry composition. In embodiments, the laundry composition may include a weight percent of lipase of from 0.1 wt. % to 7 wt. %, from 0.1 wt. % to 5 wt. %, from 0.1 wt. % to 3 wt. %, from 1 wt. % to 7 wt. %, from 1 wt. % to 5 wt. %, from 1 wt. % to 3 wt. %, from 2 wt. % to 7 wt. %, from 2 wt. % to 5 wt. %, from 3 wt. % to 7 wt. %, or from 3 wt. % to 5 wt. % based on the total weight of the laundry composition. In embodiments, the laundry composition may include a weight percent of mannanase of from 0.1 wt. % to 7 wt. %, from 0.1 wt. % to 5 wt. %, from 0.1 wt. % to 3 wt. %, from 1 wt. % to 7 wt. %, from 1 wt. % to 5 wt. %, from 1 wt. % to 3 wt. %, from 2 wt. % to 7 wt. %, from 2 wt. % to 5 wt. %, from 3 wt. % to 7 wt. %, or from 3 wt. % to 5 wt. % based on the total weight of the laundry composition. In some embodiments, the laundry composition may include a combination of protease, amylase, mannanase, and lipase. In some embodiments, the laundry composition may include from 0.1 wt. % to 5 wt. % protease coated granules, from 0.1 wt. % to 5 wt., % amylase coated granules, from 0.1 wt. % to 5 wt. % lipase coated granules, and from 0.1 wt. % to 5 wt. % mannanase coated granules. The enzyme composition may include one or more other enzymes, such as cellulase enzymes for example. In embodiments, the laundry composition may include from 0.1 wt. % to 5 wt. % of other specialty enzymes with special functions.

Oxidizing Composition

The laundry composition includes an oxidizing composition, which may also be referred to as a bleaching composition. The oxidation mechanism, accomplished through use of the oxidizing composition, facilitates removal of tough food stains and other organic stains by chemical oxidation. For example, the oxidizing composition may effectively oxidize polyphenolic compounds commonly found in coffee, tea, wine, and fruit stains. It is understood that other compounds in food stains may also be removed through the oxidation mechanism. Oxidation by the oxidizing composition may also aid in bleaching, whitening, and disinfecting fabrics. In addition to the washing benefits, the oxidizing composition may provide additional washing machine cleanliness and odor prevention benefits through the biocidal activity of the oxidizing composition.

The oxidizing composition includes an oxidizing agent and may optionally include a bleaching activator. In some embodiments, the oxidizing agent may be a chlorine donating compound, such as sodium hypochlorite or calcium hypochlorite, for example. In other embodiments, the oxidizing agent may be a peroxide-based oxidizing agent. Peroxide-based oxidizing agents suitable for use in the laundry composition include, but are not limited to sodium percarbonate and sodium perborate, for example. In some embodiments, the oxidizing agent is sodium percarbonate. The oxidizing agent may be coated to provide chemical stability during shipment, handling, and processing, and to enhance the shelf life and effectiveness of the laundry composition. In some embodiments, different coatings with different oxygen release rates into the wash solution may be used to coat the oxidizing agent to further improve the overall cleaning performance of the laundry composition.

The bleaching activator may be employed to improve the performance of the peroxide-based oxidizing agent. In aqueous solution, such as in an aqueous washing solution during a laundry cleaning process, the bleaching activator reacts with the peroxide of the peroxide-based oxidizing agent., such as sodium percarbonate for example, to form peroxy acids which have enhanced bleaching/oxidation activity compared to the peroxide. The oxidizing composition may include a cold water activator, a warm water activator, or both a cold water activator and a warm water activator. A cold water activator exhibits enhanced beaching activation at colder wash temperatures and a warm water activator exhibits enhanced bleaching activation at warmer wash temperatures. Examples of bleaching activators include, but are not limited to, tetraacetylethylenediamine (TAED) and sodium nonanoyloxybenzenesulfonate (NOBS). The NOBS activator is a cold water activator and may be preferred over TAED for cold water washing and also for removal of hydrophobic soils from fabrics. Alternatively, TAED is a warm water activator and may provide enhanced performance at warmer wash temperatures as well as facilitate removal of hydrophilic stains. Other activators may be considered if performance is comparable to NOBS across a wide range of stain types with cold water temperature washing. In some embodiments, the bleaching activator is NOBS. Alternatively, in other embodiments, the bleaching activator may be TAED.

In some embodiments, the bleaching activator may include a mixture of NOBS and TAED. The combination of NOBS, which is a cold water activator, with TAED, which is a warm water activator, creates a synergistic effect that provides efficient oxidation of both hydrophilic and hydrophobic stains and that is useful across a broad range of water temperatures. When included in the laundry composition, the oxidizing composition having both a cold water activator and a warm water activator provides improved oxidation of stains on soiled fabrics over a broader range of wash water temperatures compared to compositions having only a single activator. The interaction of NOBS and TAED with the sodium percarbonate in an aqueous wash solution may result in a mixture of peracetic acid and pernonanoic acid in the aqueous washing solution. Synergistic effects between the peracetic acid and pernonanoic acid in the aqueous wash solution may result in enhanced biocidal properties of the oxidizing composition in the aqueous wash solution. For a bleaching activator that includes both NOBS and TAED, a weight ratio of the NOBS to the TAED in the oxidizing composition may be from 15:85 to 85:15, from 15:85 to 75:25, from 15:85 to 65:35, from 15:85 to 55:45, from 15:85 to 45:55, from 15:85 to 35:65, from 15:85 to 25:75, from 25:75 to 85:15, from 25:75 to 75:25, from 25:75 to 65:35, from 25:75 to 55:45, from 25:75 to 45:55, from 25:75 to 35:65, from 35:65 to 85:15, from 35:65 to 75:25, from 35:65 to 65:35, from 35:65 to 55:45, from 35:65 to 45:55, from 45:55 to 85:15, from 45:55 to 75:25, from 45:55 to 65:35, from 45:55 to 55:45, from 55:45 to 85:15, from 55:45 to 75:25, from 55:45 to 65:35, from 65:35 to 85:15, from 65:35 to 75:25, or from 75:25 to 85:15.

The oxidizing composition may also optionally include a bleaching catalyst to catalyze the decomposition of the oxidizing agent. Typical bleaching catalysts include heavy metal complexes comprising a heavy metal ion complexed by the plurality of ligands. Heavy metal ions may include metals from Groups Va, VIa, VIIa, VIII, and Ib of the Periodic Table. In particular, the heavy metals may include, but are not limited to, cobalt, copper, iron, manganese, or combinations of these metals. In some embodiments, the bleaching catalyst may include a manganese complex. Ligands may generally include, but are not limited to, gluconates, cyclic amines, linear or branched alkyl amines, or other types of ligands. In particular, suitable ligands may include, but are not limited to, 1,4,7-triazacyclononane (TACN), 1,4,7-trimethyl-1,4,7-triazacyclononane ($Me_3$-TACN), 1,5,9-trimethyl-1,5,9-triazacyclononane, 1,5,9-triazacyclododecane, 1,4,7-triazacycloundecane, tris[2-(salicylideneamino)ethyl] amine, other ligands, or combinations of these ligands. Other commercially available bleaching catalysts may also be suitable for inclusion in the oxidizing composition.

In some embodiments, the oxidizing composition includes sodium percarbonate as the oxidizing agent and a mixture of NOBS and TAED as the bleaching activators. The sodium percarbonate may be present in the oxidizing composition in a stoichiometric excess of 100% to 500% relative to the total molar concentration of the activators. The NOBS activator and/or the TAED activator may be at sufficiently high concentrations in the laundry composition, such as from 3 wt. % to 15 wt. %, based on the total weight of the laundry composition, so that a threshold concentration of peroxy acids in the aqueous laundry washing solution results from a laundry composition having a total weight of from 12 grams to 35 grams. In some embodiments, the oxidizing composition may include a molar ratio of the oxidizing agent to the bleaching activator of from 50:50 to 90:10, from 50:50 to 80:20, from 50:50 to 70:30, from 50:50 to 60:40, from 55:45 to 90:10, from 55:45 to 80:20, from 55:45 to 70:30, from 60:40 to 90:10, from 60:40 to 80:20, from 60:40 to 70:30, or from 70:30 to 90:10.

The laundry composition may include a weight percent of the oxidizing composition of from 1 wt. % to 40 wt. %, from 1 wt % to 35 wt. %, from 1 wt. % to 30 wt. %, from 1 wt. % to 25 wt. %, from 1 wt. % to 20 wt. %, from 3 wt. % to 40 wt. %, from 3 wt. % to 35 wt. %, from 3 wt. % to 30 wt. %, from 3 wt. % to 25 wt. %, from 3 wt. % to 20 wt. %, from 5 wt. % to 40 wt. %, from 5 wt. % to 35 wt. %, from 5 wt. % to 30 wt. %, from 5 wt. % to 25 wt. %, from 5 wt. % to 20 wt. %, from 10 wt. % to 40 wt. %, from 10 wt. % to 35 wt. %, from 10 wt. % to 30 wt. %, from 10 wt. % to 25 wt. %, from 10 wt. % to 20 wt. %, from 20 wt. % to 40 wt. %, from 20 wt. % to 35 wt. %, from 20 wt. % to 30 wt. %, from 20 wt. % to 25 wt. %, from 25 wt. % to 40 wt. %, from 25 wt. % to 35 wt. %, or from 25 wt. % to 30 wt. %, based on the total weight of the laundry unit dose formulation.

In some embodiments, the oxidizing agent may be sodium percarbonate, and the laundry composition may have a weight percent of sodium percarbonate of from 1 wt. % to 25 wt. %, from 1 wt. % to 20 wt. %, from 1 wt. % to 15 wt. %, from 1 wt. % to 10 wt. %, from 3 wt. % to 25 wt. %, from 3 wt. % to 20 wt. %, from 3 wt. % to 15 wt. %, from 3 wt. % to 10 wt. %, from 5 wt. % to 25 wt. %, from 5 wt. % to 20 wt. %, from 5 wt. % to 15 wt. %, from 5 wt. % to 10 wt. %, from 10 wt. % to 25 wt. %, from 10 wt. % to 20 wt. %, from 15 wt. % to 25 wt. %, from 15 wt. % to 20 wt. %, or from 1 wt. % to 5 wt. %, based on the total weight of the laundry composition.

The laundry composition may have a weight percent of NOBS of from 1 wt. % to 20 wt. %, from 1 wt. % to 15 wt. %, from 1 wt. % to 10 wt. %, from 3 wt. % to 20 wt. %, from 3 wt. % to 15 wt. %, from 3 wt. % to 10 wt. %, from 5 wt. % to 20 wt. %, from 5 wt. % to 15 wt. %, from 5 wt. % to 10 wt. %, from 10 wt. % to 20 wt. %, from 10 wt. % to 15 wt. %, from 15 wt. % to 20 wt. %, or from 1 wt. % to 5 wt. %, based on the total weight of the laundry composition. The laundry composition may optionally include a weight percent of TAED of from 1 wt. % to 20 wt. %, from 1 wt. % to 15 wt. %, from 1 wt. % to 10 wt. %, from 3 wt. % to 20 wt. %, from 3 wt. % to 15 wt. %, from 3 wt. % to 10 wt. %, from 5 wt. % to 20 wt. %, from 5 wt. % to 15 wt. %, from 5 wt. % to 10 wt. %, from 10 wt. % to 20 wt. %, from 10 wt. % to 15 wt. %, from 15 wt. % to 20 wt. %, or from 1 wt. % to 5 wt. % based on the total weight of the laundry composition.

Surfactant Composition

As previously described, the laundry composition includes one or more surfactants. Surfactants are included in the laundry composition to facilitate removal of particulate matter and oily soil from fabrics. Surfactant selection and quantities may be determined by balancing the factors of cold water solubility, critical micelle concentration (CMC), hardness ion tolerance, foam, and soil removal performance. The surfactants may include one or more anionic sufactants and/or nonionic surfactants. Examples of surfactants suitable for use in the laundry composition include, but are not limited to, sodium alkyl aryl sulfonate, sodium dodecylbenzene sulfonate (NaDBSA), the monoethanolamine salt of dodecylbenzene sulfonate, methyl ester sulfonates (MES) such as sodium alkyl methyl ester sulfonate and sodium fatty acid methyl ester sulfonate, sodium alkyl sulfate, sodium lauryl sulfate (SLS), sodium lauryl ether sulfate (SLES), sodium alkyl ether sulfate, alkyl ethoxylated sulfates, alkyl alkoxylated sulfates, alpha olefin sulfonates (AOS), alcohol ethoxylates, alcohol ethoxylated sulfates, other surfactants, and combinations of these surfactants. Suitable surfactants may also include alkyl benzene sulfonates having alkyl groups that may be linear or branched alkyl groups having from 10 carbon atoms to 16 carbon atoms.

Anionic surfactants are the principal surfactants for particulate soil removal. Suitable anionic surfactants may include, but are not limited to NaDBSA, the monoethanolamine salt of DBSA, alkyl sulfates, alkyl ethoxylated sulfates, alkoxylated sulfates, alcohol alkoxylated sulfates, MES, other anionic surfactants, and combinations of these anionic surfactants. In some embodiments, the surfactants may include NaDBSA. Cold water solubility considerations favor the use of NaDBSA as an anionic surfactant in the laundry composition, despite its water hardness intolerance. Optionally, in some embodiments, the surfactants may include the monoethanolamine salt of DBSA, which may be used to enhance solubility. In some embodiments, the surfactants may optionally include alkyl sulfates, which despite water hardness intolerance, may be incorporated. Branched chain alkyl sulfates have better cold water solubility than straight chain alkyl sulfates, and smaller hydrophobic chain surfactants dissolve faster. However, a balance between solubility, speed, CMC, oil/water interfacial tension, and soil removal performance may be a consideration. In some embodiments, the surfactants may include alkyl ethoxylated and/or alkoxylated sulfates, which may exhibit enhanced water hardness tolerance compared to NaDBSA and alkyl sulfates. However, incorporation of the alkyl ethoxylated and/or alkoxylated sulfates into powders may be difficult as these compounds are typically available commercially as pastes or liquids. In embodiments, the surfactants may optionally include alcohol alkoxylated sulfates. Alcohol ethoxylated sulfates that have branched hydrophobic groups may provide improved solubility, and alcohol alkoxylated sulfates with relatively long hydrophobic groups (with or without branching) and hydrophilic groups may be well-suited for cold water detergency by providing low interfacial tension and fast solubilization. In some embodiments, the surfactants may include MES, which exhibits enhanced water hardness tolerance and low CMC compared to NaDBSA. However, due to hydrolysis potential MES may be added only in a dry process.

The surfactants may also include one or more nonionic surfactants, which may provide enhanced performance for removing very hydrophobic oily soil and for cleaning hydrophobic polyester and polyester/cotton blend fabrics. Examples of nonionic surfactants may include, but are not limited to, alcohol ethoxylates (linear or branched), alcohol alkoxylates (linear or branched), or combinations of these nonionic surfactants. Suitable alcohol ethoxylates and/or alcohol alkoxylates may include a hydrocarbonyl group having from 2 to 20 carbon atoms, from 10 to 18 carbon atoms, or from 12 to 15 carbon atoms. The alcohol ethoxylates may be ethoxylated with from 2 to 15 moles of ethylene oxide, or from 5 to 10 moles of ethylene oxide. In some embodiments, the laundry composition may include an alcohol ethoxylate having a hydrocarbonyl group with 12 to 15 carbon atoms ethoxylated with 7 moles of ethylene oxide. Nonionic surfactants generally have a lower CMC and lower oil/water interfacial tension than most anionic surfactants. Selection of nonionic surfactants may be based on the physical properties of the nonionic surfactants, such as one or more of the melting point, dissolution rate, water solubility, oil/water interfacial tension, and CMC of the nonionic surfactant, for example. These physical and chemical properties and performance of the nonionic surfactants may be influenced by the degree of branching, the position and length of branches, the relative size of the hydrophobic and hydrophilic groups, and the composition of the hydrophilic groups of the nonionic surfactant. For example, Guerbet alcohol ethoxylates (branched) are particularly useful in cold water, due to improved solubility. Narrow range ethoxylates can be used for improved water solubility and performance as well. Smaller molecules, with the appropriate balance of hydrophobe to hydrophile size, such as CS-10 hydrophobes with 6 moles of ethylene oxide for example, offer faster dissolution and better cold water solubility than conventional nonionic surfactants (e.g., NEODOL® 25-9 surfactant manufactured by Shell Chemicals, an affiliate of Shell Global) used in laundry products.

Many bulk surfactants are available in liquid form. Solid versions of liquid surfactants are available in the form of spray dried solids. However, these spray dried solid surfactants are expensive and have a much lower packed density than the other solid active components of the laundry composition. In some embodiments, bulk liquid surfactant components may be combined with one or more of the solid active components of the laundry composition, such as but not limited to sodium carbonate, zeolites, or sodium silicates for example, to form powder intermediates that may then be blended with the other solid components to make the powder laundry composition. It is particularly preferred, for cost effectiveness and density attainment, to prepare some of the neutralized anionic surfactants in-situ by combining acid forms of either alkyl aryl sulphonic acid and/or alkyl ethoxylated sulfuric acid onto an alkaline base such as sodium carbonate. Methods of forming the powder intermediates are subsequently discussed in further detail in this disclosure.

The laundry composition may have a total weight percent of a surfactant composition of from 15 wt. % to 80 wt. %, from 15 wt. % to 75 wt. %, from 15 wt. % to 72 wt. %, from 15 wt. % to 60 wt. %, from 15 wt. % to 50 wt. %, from 15 wt. % to 40 wt. %, from 20 wt. % to 80 wt. %, from 20 wt. % to 75 wt. %, from 20 wt. % to 72 wt. %, from 20 wt. % to 60 wt. %, from 20 wt. % to 50 wt. %, from 20 wt. % to 40 wt. %, from 30 wt. % to 80 wt. %, from 30 wt. % to 75 wt. %, from 30 wt. % to 72 wt. %, from 30 wt. % to 60 wt. %, from 30 wt. % to 50 wt. %, from 30 wt. % to 40 wt. %, from 40 wt. % to 80 wt. %, from 40 wt. % to 75 wt. %, from 40 wt. % to 72 wt. %, from 40 wt. % to 60 wt. %, or from 40 wt. % to 50 wt. %, based on the total weight of the laundry composition.

In some embodiments, the surfactant composition may include NaDBSA. The laundry composition may have a weight percent of NaDBSA surfactant of from 0.1 wt. % to 25 wt. %, from 0.1 wt. % to 20 wt. %, from 0.1 wt. % to 15 wt. %, from 0.1 wt. % to 10 wt. %, from 1 wt. % to 25 wt. %, from 1 wt. % to 20 wt. %, from 1 wt. % to 15 wt. %, from 1 wt. % to 10 wt. %, from 5 wt. % to 25 wt. %, from 5 wt. % to 20 wt. %, from 5 wt. % to 15 wt. %, from 5 wt. % to 10 wt. %, from 10 wt. % to 25 wt. %, from 10 wt. % to 20 wt. %, from 10 wt. % to 15 wt. %, from 15 wt. % to 25 wt. %, from 15 wt. % to 20 wt. %, from 20 wt. % to 25 wt. %, or from 0.1 wt. % to 5 wt. % based on the total weight of the laundry composition.

The surfactant composition may include a mixture of one or more anionic and/or nonionic surfactants. In some embodiments, the surfactant composition may include NaDBSA and one or more of sodium alkyl methyl ester sulfonate, sodium alkyl sulfate, sodium alkyl ethoxy sulfate, alcohol ethoxylate, or alcohol alkoxylate. In some embodiments, the laundry composition may optionally include from 0.1 wt. % to 25 wt. % sodium alkyl methyl ester sulfonate, from 0.1 wt. % to 10 wt. % sodium alkyl methyl ester sulfonate in other embodiments, or from 0.1 wt. % to 5 wt. % sodium alkyl methyl ester sulfonate in still other embodiments. In some embodiments, the laundry composition may optionally include from 0.1 wt. % to 25 wt. % of sodium alkyl sulfate, from 0.1 wt. % to 10 wt. % sodium alkyl sulfate in other embodiments, or from 0.1 wt. % to 5 wt. % in still other embodiments. In some embodiments, the laundry composition may optionally include from 0.1 wt. % to 25 wt. % of sodium alkyl ethoxy sulfate, from 0.1 wt. % to 10 wt. % sodium alkyl ethoxy sulfate in other embodiments, or from 0.1 wt. % to 5 wt. % sodium alkyl ethoxy sulfate in still other embodiments. In some embodiments, the laundry composition may include from 0.1 wt. % to 25 wt. % of one or more alcohol ethoylates and/or alcohol alkoxylates, from 0.1 wt. % to 10 wt. % of one or more alcohol ethoylates and/or alcohol alkoxylates in other embodiments, or from 0.1 wt. % to 5 wt. % of one or more alcohol ethoylates and/or alcohol alkoxylates in yet other embodiments.

Alkaline Compound/Detergent Builder

The laundry composition may include one or more alkaline compounds and/or detergent builders. Alkaline compounds may be included in the laundry composition to facilitate neutralizing fatty acids present in various stain materials. Detergent builders and other bivalent metal ion control agents may facilitate removal of calcium and magnesium ions from the aqueous washing solution through precipitation, sequestration, chelation, and/or ion-exchange. Detergent builders may reduce the hardness of the aqueous washing solution by removing some of the calcium and magnesium. Calcium and magnesium ions may interfere with and/or reduce the effectiveness of the other active components of the laundry composition.

The laundry composition may include one or more alkaline compounds that also provide metal ion control to provide detergent building properties. Examples of suitable alkaline compounds that also exhibit detergent building properties include, but are not limited to, one or more of sodium carbonate, sodium silicate, hydrous polysilicate granules (e.g., sodium disilicate or other ratios of $SiO_2$:$Na_2O$), sodium metasilicate, layered silicates such as delta-disodium silicate ($Na_2Si_2O_5$), or combinations of these alkaline compounds. These alkaline compounds may aid in bivalent metal ion precipitation, sequestration, and/or ion exchange for improved surfactant detergency. The alkaline compounds described above may also improve particulate removal, provide anti-re-deposition benefits, and increase the pH of the aqueous washing solution to convert sebum and food fatty acids to effective soaps in-situ. Sodium carbonate, sodium alumino silicate, and hydrous polysilicates (e.g., hydrous disilicates) provide synergies between alkalinity/pH control, calcium control, liquid surfactant absorption, and soil removal benefits in a weight efficient manner. Other combinations of compounds are contemplated. For warmer water cleaning applications, the delta-disodium silicate has adequate solubility and may be considered in this context.

The laundry composition may also include one or more detergent builders that do not simultaneously impart alkalinity on the aqueous washing solution. Examples of non-alkaline detergent builders suitable for inclusion in the laundry composition may include, but are not limited to, sodium alumino silicates (e.g. zeolites, such as Zeolite A or other suitable zeolites), sodium citrates, other detergent builders, and combinations thereof. These detergent builders can be considered as a bivalent metal ion control agents. However, these detergent builders may need to be used in conjunction with other detergent builders. Sodium alumino silicates provide enhanced liquid absorption and flowability compared to other detergent builders. Enhanced liquid absorption and flowability may facilitate absorption of one or more liquid components, such as a liquid surfactant, onto a solid in order to incorporate the liquid component into the solid powder laundry composition.

In some embodiments, the laundry composition may include a total weight percent of alkaline compounds of from 5 wt. % to 50 wt. %, from 5 wt. % to 40 wt. %, from 5 wt. % to 30 wt. %, from 5 wt. % to 20 wt. %, from 10 wt. % to 50 wt. %, from 10 wt. % to 40 wt. %, from 10 wt. % to 30 wt. %, from 10 wt. % to 20 wt. %, from 15 wt. % to 50 wt. %, from 15 wt. % to 40 wt. %, from 15 wt. % to 30 wt. %, from 15 wt. % to 20 wt. %, from 20 wt. % to 50 wt. %, from 20 wt. % to 40 wt. %, from 20 wt. % to 30 wt. %, from 30 wt. % to 50 wt. %, from 30 wt. % to 40 wt. %, or from 40 wt. % to 50 wt. % based on the total weight of the laundry composition.

In some embodiments, the laundry composition may include a total weight percent of detergent builders and other bivalent metal ion control agents of from 10 wt. % to 50 wt. %, from 10 wt. % to 40 wt. %, from 10 wt. % to 30 wt. %, from 10 wt. % to 20 wt. %, from 15 wt. % to 50 wt. %, from 15 wt. % to 40 wt. %, from 15 wt. % to 30 wt. %, from 15 wt. % to 20 wt. %, from 20 wt. % to 50 wt. %, from 20 wt. % to 40 wt. %, from 20 wt. % to 30 wt. %, from 30 wt. % to 50 wt. %, from 30 wt. % to 40 wt. %, or from 40 wt. % to 50 wt. % based on the total weight of the laundry composition.

In some embodiments, the laundry composition may include sodium carbonate. The laundry composition may have a weight percent of sodium carbonate of from 5 wt. % to 50 wt. %, from 5 wt. % to 40 wt. %, from 5 wt. % to 30 wt. %, from 5 wt. % to 20 wt. %, from 10 wt. % to 50 wt. %, from 10 wt. % to 40 wt. %, from 10 wt. % to 30 wt. %, from 10 wt. % to 20 wt. %, from 15 wt. % to 50 wt. %, from 15 wt. % to 40 wt. %, from 15 wt. % to 30 wt. %, from 20 wt. % to 50 wt. %, from 20 wt. % to 40 wt. %, from 20 wt. % to 30 wt. %, from 25 wt. % to 50 wt. %, from 25 wt. % to 40 wt. %, from 25 wt. % to 30 wt. %, from 30 wt. % to 50 wt. %, from 30 wt. % to 40 wt. %, or from 40 wt. % to 50 wt. % based on the total weight of the laundry composition.

In some embodiments, the laundry composition may include sodium disilicate. A non-limiting example of a layered sodium disilicate may include SKS® brand layered sodium disilicate available from WeylChem Lamotte S.A.S., Trosly-Breuil, France. The laundry composition may have a weight percent of sodium disilicate of from 0.1 wt. % to 20 wt. %, from 0.1 wt. % to 15 wt. %, from 0.1 wt. % to 10 wt. %, from 0.1 wt. % to 5 wt. %, from 1 wt. % to 20 wt. %, from 1 wt. % to 15 wt. %, from 1 wt. % to 10 wt. %, from 1 wt. % to 5 wt. %, from 5 wt. % to 20 wt. %, from 5 wt. % to 15 wt. %, from 5 wt. % to 10 wt. %, from 10 wt. % to 20 wt. %, from 10 wt. % to 15 wt. %, or from 15 wt. % to 20 wt. % based on the total weight of the laundry composition.

In some embodiments, the laundry composition may include other sodium silicates, disilicates, and/or metasilicates. The laundry composition may have a total weight percent of sodium silicates and/or metasilicates of from 0.1 wt. % to 20 wt. %, from 0.1 wt. % to 15 wt. %, from 0.1 wt. % to 10 wt. %, from 0.1 wt. % to 5 wt. %, from 1 wt. % to 20 wt. %, from 1 wt. % to 15 wt. %, from 1 wt. % to 10 wt. %, from 1 wt. % to 5 wt. %, from 5 wt. % to 20 wt. %, from 5 wt. % to 15 wt. %, from 5 wt. % to 10 wt. %, from 10 wt. % to 20 wt. %, from 10 wt. % to 15 wt. %, or from 15 wt. % to 20 wt. % based on the total weight of the laundry composition. In some embodiments, the laundry composition may include at least one of sodium disilicate, sodium silicate, metasilicates, or combinations of these.

In some embodiments, the laundry composition may include one or more zeolites. The laundry composition may have a weight percent of zeolites of from 0.1 wt. % to 20 wt. %, from 0.1 wt. % to 15 wt. %, from 0.1 wt. % to 10 wt. %, from 0.1 wt. % to 5 wt. %, from 1 wt. % to 20 wt. %, from 1 wt. % to 15 wt. %, from 1 wt. % to 10 wt. %, from 1 wt. % to 5 wt. %, from 5 wt. % to 20 wt. %, from 5 wt. % to 15 wt. %, from 5 wt. % to 10 wt. %, from 10 wt. % to 20 wt. %, from 10 wt. % to 15 wt. %, or from 15 wt. % to 20 wt. % based on the total weight of the laundry composition. In some embodiments, the laundry composition may include from 5 wt. % to 50 wt. % sodium carbonate, from 0.1 wt. % to 20 wt. % sodium disilicates, from 0.1 wt. % to 20 wt. % sodium silicates and/or metasilicates, and 0.1 wt. % to 20 wt. % zeolites.

Chelants

The laundry composition may include one or more strong metal ion chelants. Chelation with the strong metal ion chelant provides water soluble chelation, which may contribute to improved bleaching stability and removal of specific stains. Chelants have a strong affinity for metal ions and facilitate sequestration of metal ions present in stains and in the wash solution. Decreasing the concentration of metal ions in the wash solution may improve stability of the oxidizing composition (bleaching composition) to improve bleaching performance. Chelants, sometimes referred to in the art as chelating agents or sequestration agents, may have high stability constant logarithms for both calcium and heavier metal ions (e.g., pK(Ca) greater than 5, where pK(Ca) is the stability constant logarithm for calcium) at the relevant wash pH conditions. The stability constant logarithm, pK(M) is a measure of the strength of the complex between the metal ion (M) and the chelant at the relevant wash pH conditions.

Strong chelants with a relatively high stability constants for both calcium and heavier metal ions (i.e. pK(Ca)>5) at the relevant wash pH conditions include chelants suitable for use in detergent formulations and/or water treatment compositions. Suitable chelants may include, but are not limited to, phosphates, phosphonates, aminopolycarboxylic acids, polyamino phosphonic acids, or other chelating agents. For examples, chelants suitable for use in the laundry composition may include, but are not limited to, diethylenetriamine penta(methylene phosphonic acid) (DTPMPA), ethylenediamine tetra(methylene phosphonic acid (EDTMPA), diethylenetriamine pentaacetic acid (DTPA), methylglycine diacetic acid (MGDA), N,N-bis(carboxymethyl) glutamic acid (GLDA), ethylene diamine tetraacetic acid (EDTA), iminodisuccinic acid (IDS), 2-phosphonobutane-1,2,4-tricarboxylic acid (PBTC), 1-hydroxyethane-1,1-diphosphonic acid (HEDP), other polyamino phosphonic acid chelants, or combinations of these chelants. Suitable chelants may also include the salts of any of the aforementioned chelants, such as the pentasodium salt of DTPA and the heptasodium salt of DTPMPA, as non-limiting examples. Other examples of slightly weaker chelants that may be suitable for use in the laundry composition may include, but are not limited to, ethylenediamine-N,N-disuccinic acid (EDDS). In some embodiments, the laundry composition may include DTPMPA or the heptasodium salt of DTPMPA. In some embodiments, the laundry composition may include DTPA or the pentasodium salt of DTPA.

The laundry composition may have a total weight percent of strong metal ion chelants of from 0.5 wt. % to 20 wt. %, from 0.5 wt. % to 18 wt. %, from 0.5 wt. % to 15 wt. %, from 0.5 wt. % to 12 wt. %, from 0.5 wt. % to 10 wt. %, from 1 wt. % to 20 wt. %, from 1 wt. % to 18 wt. %, from 1 wt. % to 15 wt. %, from 1 wt. % to 12 wt. %, from 1 wt. % to 10 wt. %, from 3 wt. % to 20 wt. %, from 3 wt. % to 18 wt. %, from 3 wt. % to 15 wt. %, from 3 wt. % to 12 wt. %, from 3 wt. % to 10 wt. %, from 5 wt. % to 20 wt. %, from 5 wt. % to 18 wt. %, from 5 wt. % to 15 wt. %, from 5 wt. % to 12 wt. %, from 5 wt. % to 10 wt. %, from 10 wt. % to 20 wt. %, from 10 wt. % to 18 wt. %, from 10 wt. % to 15 wt. %, from 12 wt. % to 20 wt. %, from 12 wt. % to 18 wt. %, from 12 wt. % to 15 wt. %, or from 15 wt. % to 20 wt. % based on the total weight of the laundry composition.

In some embodiments, the chelant may include one or both of pentasodium DTPA and MGDA. In these embodiments, the laundry composition may include a weight percent of pentasodium DTPA of from 0.1 wt. % to 10 wt. %, from 0.1 wt. % to 8 wt. %, from 0.1 wt. % to 6 wt. %, from 1 wt. % to 10 wt. %, from 1 wt. % to 8 wt. %, from 1 wt. % to 6 wt. %, from 2 wt. % to 10 wt. %, from 2 wt. % to 8 wt. %, from 2 wt. % to 6 wt. %, from 6 wt. % to 10 wt. %, from 6 wt. % to 8 wt. %, or from 8 wt. % to 10 wt. % based on the total weight of the laundry composition.

In some embodiments, the chelant may include MGDA. In these embodiments, the laundry composition may include a weight percent of MGDA of from 0.1 wt. % to 10 wt. %, from 0.1 wt. % to 8 wt. %, from 0.1 wt. % to 6 wt. %, from 1 wt. % to 10 wt. %, from 1 wt. % to 8 wt. %, from 1 wt. % to 6 wt. %, from 2 wt. % to 10 wt. %, from 2 wt. % to 8 wt. %, from 2 wt. % to 6 wt. %, from 6 wt. % to 10 wt. %, from 6 wt. % to 8 wt. %, or from 8 wt. % to 10 wt. % based on the total weight of the laundry composition. In some embodiments, the laundry composition may include from 0.1 wt. % to 10 wt. % pentasodium DTPA and from 0.1 wt. % to 10 wt. % MDGA.

Detersive Polymers

The laundry composition may include one or more detersive polymers. The detersive polymers may have anionic or nonionic character and may provide multi-functional cleaning ability to contribute to soil removal from fabrics being washed with the laundry composition. For example, detersive polymers may contribute to suspension of soils in the wash solution and may function as anti-redeposition agents to prevent compounds removed from the fabric from redepositing on the fabric during the washing process. Other detersive or multi-functional polymers may be included that provide calcium carbonate crystal control and/or inhibition, which may aid in minimizing precipitation of calcium carbonate crystals (i.e., scale) on the surfaces of fabrics being laundered (i.e., anti-encrustation effect) and the surfaces of the laundry washing vessel. Detersive polymers may also be used to chelate and/or sequester water hardness ions such as calcium to aid in the detergent performance. The detersive polymers may be included to augment the particulate soil removal and work synergistically with the surfactant, detergent builders, and strong ion chelants. As a non-limiting example of synergies between a detersive polymer and surfactants, the detersive polymer may control the concentration of calcium ions in the aqueous wash solution, which may prevent precipitation of certain surfactants, such as alkyl aryl sulfonates and sodium lauryl sulfate for example, which allows the surfactants to be more effective. Other synergistic effects of the detersive polymers and the surfactants, detergent builders, and strong ion chelants may also result.

Detersive polymers that may be suitable for including into the laundry composition may include, but are not limited to, polyacrylates, polycarboxylates, high charge density carboxylates, co-polymers of acrylic and maleic acid (AA/MA copolymer), other detersive polymers, and combinations of these detersive polymers. Other suitable detersive polymers may include polymers having two, three, four, five, or six different monomer moieties, and/or with modified hydrophobic or hydrophilic side chains, to provide other synergies with other components of the formulation. Non-limiting examples of suitable detersive polymers may include polyethyleneimine ethoxylated and/or alkoxylated polymers, such as SOKALAN® brand detersive polymers marketed by BASF. Suitable detersive polymers may also include bio-based detersive polymers. Examples of bio-based detersive polymers include, but are not limited to, sodium polyitaconate and carboxymethyl inulin. Polyaspartates may also be used as a detersive polymer in the laundry composition. Optionally, other specialty polymers typically used in detergent compositions, such as carboxymethyl cellulose and polyvinyl pyrrolidone, may be included in the laundry composition to provide cotton anti-redepositon properties and dye transfer inhibition benefits to the laundry composition. Optionally, soil release polymers having at least a hydrophobic portion and at least a hydrophilic portion may be added to the laundry composition to impart a more hydrophilic surface to polyesters, making it easier for water and cleaning agents to diffuse into the soil/fabric interface, and preventing soils from strongly absorbing onto the fabric. In embodiments, the laundry composition may include a mixture of a plurality of detersive polymers or multi-functional polymers.

The laundry composition may have a total weight percent of polymers, including detersive polymers and/or multi-functional polymers, of from 0.5 wt. % to 20 wt. %, from 0.5 wt. % to 18 wt. %, from 0.5 wt. % to 15 wt. %, from 0.5 wt. % to 12 wt. %, from 0.5 wt. % to 10 wt. %, from 1 wt. % to 20 wt. %, from 1 wt. % to 18 wt. %, from 1 wt. % to 15 wt. %, from 1 wt. % to 12 wt. %, from 1 wt. % to 10 wt. %, from 3 wt. % to 20 wt. %, from 3 wt. % to 18 wt. %, from 3 wt. % to 15 wt. %, from 3 wt. % to 12 wt. %, from 3 wt. % to 10 wt. %, from 5 wt. % to 20 wt. %, from 5 wt. % to 18 wt. %, from 5 wt. % to 15 wt. %, from 5 wt. % to 12 wt. %, from 5 wt. % to 10 wt. %, from 10 wt. % to 20 wt. %, from 10 wt. % to 18 wt. %, from 10 wt. % to 15 wt. %, from 12 wt. % to 20 wt. %, from 12 wt. % to 18 wt. %, from 12 wt. % to 15 wt. %, or from 15 wt. % to 20 wt. % based on the total weight of the laundry composition.

In some embodiments, the laundry composition may include an AA/MA copolymer and/or the sodium salt of the AA/MA copolymer. The AA/MA copolymer may have a molar ratio of acrylic monomer to maleic monomer of from 60:40 to 80:20, from 60:40 to 75:25, from 60:40 to 70:30, from 65:35 to 80:20, from 65:35 to 75:25, from 65:35 to 70:30, from 70:30 to 80:20, or from 70:30 to 75:25. In one or more embodiments, the AA/MA copolymer may have a ratio of acrylic monomer to maleic monomer of from 65:35 to 75:25. In other embodiments, the AA/MA copolymer may have a ratio of acrylic monomer to maleic monomer of about 70:30. The laundry composition may include a weight percent of the AA/MA copolymer of from 0.1 wt. % to 10 wt. %, from 0.1 wt. % to 8 wt. %, from 0.1 wt. % to 6 wt. %, from 1 wt. % to 10 wt. %, from 1 wt. % to 8 wt. %, from 1 wt. % to 6 wt. %, from 2 wt. % to 10 wt. %, from 2 wt. % to 8 wt. %, from 2 wt. % to 6 wt. %, from 6 wt. % to 10 wt. %, from 6 wt. % to 8 wt. %, or from 8 wt. % to 10 wt. % based on the total weight of the laundry composition.

In some embodiments, the laundry composition may include polyethyleneimine ethoxylate. The laundry composition may include a weight percent of the polyethyleneimine ethoxylate of from 0.1 wt. % to 10 wt. %, from 0.1 wt. % to 8 wt. %, from 0.1 wt. % to 6 wt. %, from 1 wt. % to 10 wt. %, from 1 wt. % to 8 wt. %, from 1 wt. % to 6 wt. %, from 2 wt. % to 10 wt. %, from 2 wt. % to 8 wt. %, from 2 wt. % to 6 wt. %, from 6 wt. % to 10 wt. %, from 6 wt. % to 8 wt. %, or from 8 wt. % to 10 wt. % based on the total weight of the laundry composition. In some embodiments, the laundry composition may include from 0.1 wt. % to 10 wt. % AA/MA copolymer and from 0.1 wt. % to 10 wt. % polyethyleneimine ethoxylate. Other combinations of detersive polymers and multi-functional polymers are contemplated.

Unit Dose Laundry Composition

The laundry composition may be formulated into a unit dose laundry composition, such as a single packet or pouch of the laundry composition for use in a single laundry washing cycle. The unit dose laundry composition includes a weight of the laundry composition, which is a powder, encapsulated in a polymer film. Alternatively, the laundry composition may also be provided as a free-flowing powder. As previously described, the laundry composition, which may be a free-flowing powder or may be encapsulated in a polymer film, includes from 1 wt. % to 10 wt. % of one or more coated enzymes, from 1 wt. % to 40 wt. % of the bleach composition comprising an oxidizing agent and one or more bleach activators, from 10 wt. % to 80 wt. % of a surfactant composition, and one or more of an alkaline compound, a detergent builder, a chelant, or a polymer composition. In some embodiments, the laundry composition includes from 5 wt. % to 50 wt. % of an alkaline compound, from 10 wt. % to 50 wt. % of a detergent builder, from 0.5 wt. % to 20 wt. % of a chelant, and from 1 wt. % to 20 wt. % of a detersive polymer.

The laundry composition may include one or more additives to provide additional features to the unit dose laundry composition. The additives may include, but are not limited to foam control agents, corrosion inhibitors, optical brighteners, soil repellents, wrinkle reducer agents, fabric softeners, fragrance compounds, encapsulated fragrance compositions, colorants, color retention polymers, other specialty additives, and combinations of these additives. Foam control agents, which may be included to control foaming of the laundry washing solution, may include, but are not limited to, one or more fatty acid soaps and/or silicone defoamers. Encapsulated fragrance compositions may be used to provide extended fragrance release from laundered fabrics. The laundry composition may also include one or more compounds or compositions that function as disintegrants. These disintegrant compounds/compositions may be used to increase the rate of disintegration of the polymer film encapsulating the laundry composition and/or increase the rate of dissolution of the laundry composition in the laundry washing solution. A non-limiting example of an optical brightener includes, but is not limited to C.I. fluorescent brightener 71 (C.A.S. No. 16090-02-1). The laundry composition may include a total weight percent of additive components of from 0.1 wt. % to 10 wt. %, from 0.1 wt. % to 7 wt. %, from 0.1 wt. % to 5 wt. %, from 0.1 wt. % to 3 wt. %, from 1 wt. % to 10 wt. %, from 1 wt. % to 7 wt. %, from 1 wt. % to 5 wt. %, from 1 wt. % to 3 wt. %, from 3 wt. % to 10 wt. %, from 3 wt. % to 7 wt. %, from 3 wt. % to 5 wt. %, or from 5 wt. % to 10 wt. % based on the total weight of the laundry composition.

In some embodiments, the laundry composition may include a foam control agent, which may include a fatty acid soap defoamer, silicone defoamer, or both a fatty acid soap defoamer and silicone defoamer. The laundry composition may have a weight percent of the weight control agent of from 0.01 wt. % to 2 wt. %, from 0.01 to 1 wt. %, from 0.1 wt. % to 2 wt. %, from 0.1 wt. % to 1 wt. %, from 0.5 wt. % to 2 wt. %, from 0.5 wt. % to 1 wt. %, or from 1 wt. % to 2 wt. % based on the total weight of the laundry composition. In some embodiments, the laundry composition may include an optical brightener. The laundry composition may have a weight percent of the optical brightener of from 0.01 wt. % to 2 wt. %, from 0.01 to 1 wt. %, from 0.1 wt. % to 2 wt. %, from 0.1 wt. % to 1 wt. %, from 0.5 wt. % to 2 wt. %, from 0.5 wt. % to 1 wt. %, or from 1 wt. % to 2 wt. % based on the total weight of the laundry composition.

In some embodiments, the laundry composition may include sodium carboxymethyl cellulose. A weight percent of the sodium carboxymethyl cellulose in the laundry composition may be from 0.01 wt. % to 2 wt. %, from 0.01 to 1 wt. %, from 0.1 wt. % to 2 wt. %, from 0.1 wt. % to 1 wt. %, from 0.5 wt. % to 2 wt. %, from 0.5 wt. % to 1 wt. %, or from 1 wt. % to 2 wt. % based on the total weight of the laundry composition. In some embodiments, the laundry composition may include color retention polymers. A non-limiting example of a color retention polymer may include polyvinyl pyrrolidone, for example. Other color retention polymers are contemplated. A weight percent of the color retention polymers in the laundry composition may be from 0.01 wt. % to 2 wt. %, from 0.01 to 1 wt. %, from 0.1 wt. % to 2 wt. %, from 0.1 wt. % to 1 wt. %, from 0.5 wt. % to 2 wt. %, from 0.5 wt. % to 1 wt. %, or from 1 wt. % to 2 wt. % based on the total weight of the laundry composition.

The laundry composition and the unit dose laundry composition made therefrom may include a total weight percent of active components (i.e., cleaning compounds comprising the enzymes, oxidizing composition, surfactants, alkaline compounds, detergent builders, strong metal ion chelants, and polymers previously described as well as any other active components) of from 90 wt. % to 100 wt. %, from 90 wt. % to 99 wt. %, from 90 wt. % to 98 wt. %, from 90 wt. % to 97 wt. %, from 90 wt. % to 95 wt. %, from 90 wt. % to 94 wt. %, from 92 wt. % to 100 wt. %, from 92 wt. % to 99 wt. %, from 92 wt. % to 98 wt. %, from 92 wt. % to 97 wt. %, from 92 wt. % to 95 wt. %, from 94 wt. % to 100 wt. %, from 94 wt. % to 99 wt. %, from 94 wt. % to 98 wt. %, from 94 wt. % to 97 wt. %, from 94 wt. % to 95 wt. %, from 95 wt. % to 100 wt. %, from 95 wt. % to 99 wt. %, from 95 wt. % to 98 wt. %, from 95 wt. % to 97 wt. %, from 97 wt. % to 100 wt. %, from 97 wt. % to 99 wt. %, from 98 wt. % to 100 wt. %, from 98 wt. % to 99 wt. %, or from 99 wt. % to 100 wt. % based on the total weight of the laundry composition not including the polymer film encapsulating the laundry composition. In some embodiments, the unit dose laundry composition may include greater than or equal to 90 wt. % active components (i.e., cleaning compounds). In other embodiments, the unit dose laundry composition may include equal to or greater than 95 wt. % active components. In still other embodiments, the unit dose laundry composition may include equal to or greater than 99 wt. % active components.

Filler materials such as sodium chloride, sodium sulfate, and moisture (water) would be generally omitted from the laundry composition and the unit dose laundry composition made therefrom. As used herein, the term "filler" refers to a generally inert material that provides negligible or no contribution to the cleaning performance of the unit dose laundry composition. In specific cases, some inorganic salts may be used to augment liquid surfactant loading, such as burkeite crystal formation in powder slurry for high alcohol ethoxylate loading. In some embodiments, the laundry composition and unit dose laundry composition made therefrom may be substantially free of filler materials. As used in this disclosure, "substantially free" of a specific compound or component means less than 0.1 wt. % of the specific compound or component is present in the composition. In other embodiments, one or more fillers may be marginally and tactically used to aid in adsorption of liquid surfactants to maximize space and weight utilization.

The laundry composition used to make the unit dose laundry composition is a powdered solid composition having a bulk density of at least 500 grams per liter (g/L). The bulk density of the laundry composition as used herein refers to the loose bulk density of the unpacked powdered solid. The bulk density is measured by flowing the powdered solid of the laundry composition through a funnel and into a fixed volume vessel, such as a volumeter, volumetric flask, or fixed volume cylindrical flask for example, until the powdered solid overflows the fixed volume vessel. The excess powdered solid is scraped off of the top of the fixed volume vessel using a straight edge oriented perpendicular to a vertical wall of the fixed volume vessel. The fixed volume vessel having the powdered solid therein is then weighed and the tare weight of the empty fixed volume vessel is subtracted from the total weight to get the weight of the powdered solid. The bulk density is then calculated by as the quotient of the weight of the powdered solid divided by the volume of the fixed volume vessel. The unit dose laundry composition may have a bulk density of from 500 g/L to 1,300 g/L, from 500 g/L to 1,200 g/L, from 500 g/L to 1,100 g/L, from 500 g/L to 1,000 g/L, 500 g/L to 900 g/L, from 600 g/L to 1,300 g/L, from 600 g/L to 1,200 g/L, from 600 g/L to 1,100 g/L, from 600 g/L to 1,000 g/L, from 600 g/L to 900 g/L, from 650 g/L to 1,300 g/L, from 650 g/L to 1,200 g/L, from 650 g/L to 1,100 g/L, from 650 g/L to 1,000 g/L, from 650 g/L to 900 g/L, from 900 g/L to 1,300 g/L, or from 900 g/L to 1,200 g/L.

As previously mentioned, the unit dose laundry composition comprises a quantity of the laundry composition encapsulated in a polymer film. In embodiments, the unit dose laundry composition includes a total weight of the laundry composition of from 10 grams (g) to 35 g, from 10 g to 30 g, from 10 g to 25 g, from 10 g to 20 g, from 12 g to 35 g, from 12 g to 30 g, from 12 g to 25 g, from 12 g to 20 g, from 15 g to 35 g, from 15 g to 30 g, from 15 g to 25 g, from 15 g to 20 g, from 20 g to 35 g, from 20 g to 30 g, from 20 g to 25 g, from 25 g to 35 g, from 25 g to 30 g, from 30 g to 35 g, or from 10 g to 15 g. Alternatively, in some embodiments, the unit dose laundry composition may have a weight of from 12 g to 35 g not including the polymer film. In other embodiments, the unit dose laundry composition may have a weight of from 20 to 25 g not including the polymer film. In some embodiments, the unit dose laundry composition may have a total weight of active components of from 10 g to 35 g, from 10 g to 30 g, from 10 g to 25 g, from 10 g to 20 g, from 12 g to 35 g, from 12 g to 30 g, from 12 g to 25 g, from 12 g to 20 g, from 15 g to 35 g, from 15 g to 30 g, from 15 g to 25 g, from 15 g to 20 g, from 20 g to 35 g, from 20 g to 30 g, from 20 g to 25 g, from 25 g to 35 g, from 25 g to 30 g, from 30 g to 35 g, or from 10 g to 15 g.

The polymer film completely surrounds and/or encapsulates the quantity of the laundry composition in the unit dose laundry composition. The polymer film may be a polymer film that is at least partially or fully water-soluble such that, upon introducing the unit dose laundry composition to an aqueous laundry washing solution, the polymer film rapidly dissolves in the aqueous laundry washing solution to release the active components of the laundry composition into the aqueous laundry washing solution. Suitable polymer films may include, but are not limited to, polyvinyl alcohol (PVA) and PVA copolymers for example. The polymer used for the polymer film may have one or more additional monomers incorporated into the polymer matrix to provide specific characteristics. Additionally, the polymer film may also include at least one of a denauturant, colorant, solubilizer, plasticizing agent, or other additive. In some embodiments, the polymer film may be a polyvinyl alcohol film. Some non-limiting examples of polymer films suitable for encapsulating the laundry composition to form the unit dose laundry composition include, but are not limited to MONOSOL® M8630 polyvinyl alcohol based thermoplastic film manufactured by MonoSol, LLC (a Kuraray Co., Ltd. company), or SOLUBLON® GA-40 polyvinyl alcohol film manufactured by Aicello Corporation, Toyohashi, Japan. The polyvinyl alcohol film may have a degree of polymerization and a ratio of acetate to alcohol substitution that may results in a balance between mechanical strength and rapid water disintegration and solubility parameters. In some embodiments, the polymer film may be modified to improve dissolution in cold water.

Figure 2:
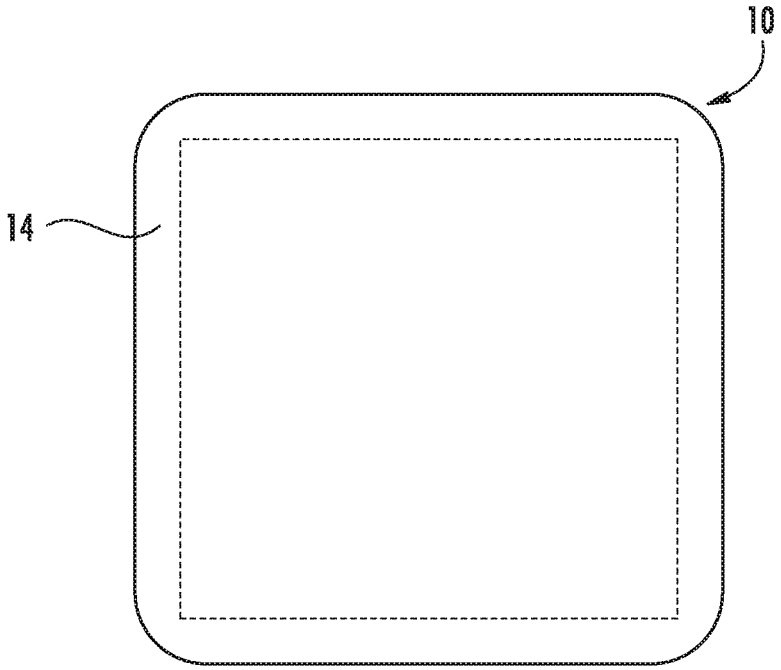
FIG. 2 schematically depicts a top view of the unit dose laundry composition of FIG. 1, in accordance with one or more embodiments of the present disclosure.

Referring to FIGS. 1 and 2, the polymer film 10 may be formed into a pouch 12 and a cover 14. The pouch 12 may be filed with an amount of the laundry composition and the cover 14 may be coupled to the pouch 12 to completely surround and contain the laundry composition within the pouch 12. A vacuum forming and filling machines may be employed to form the pouch 12, fill the pouch 12 with the laundry composition, apply the cover 14 to the pouch 12, and couple the cover 14 to the pouch 12. Non-limiting examples of machines for encapsulating the laundry composition in the polymer film to produce the unit dose laundry composition include a Model PVS rotary filler machine manufactured by Green Sustainable Packaging, or a soluble pouch machine such as those manufactured by Cloud Packaging Equipment. Other rotary filling machines, pouch filling machines, or packaging machines may also be suitable for making the unit dose laundry composition.

The polymer film may have a thickness of from 20 micrometers (μm) to 60 μm, from 20 μm to 50 μm, from 20 μm to 40 μm, from 20 μm to 30 μm, from 30 μm to 60 μm, from 30 μm to 50 μm, or from 30 μm to 40 μm. The wall thickness in a range of 20 μm to 50 μm or from 20 μm to 40 μm aids in improving the rate of disintegration and dissolution of the polymer film compared to a conventional 3 mil (76 μm) thickness polymer film typically used in conventional liquid unit doses. The polymer film may also have a porosity that may improve the disintegration and dissolution of the polymer film.

Perforations may be added to the polymer film to aid in the initial disintegration and dissolution of the film. The perforations may have a largest dimension that is smaller than the particulate components of the laundry composition so that the polymer film remains effective at encapsulating and retaining the laundry composition. In embodiments, the largest dimension of the perforations in the polymer film may be from 1 micron to 100 microns. The perforations may be added to the polymer film either off-line or on-line (i.e. during the application of the film on the vacuum forming and pod filling machine), using one of laser, electric arc or other mechanical means. In embodiments, the perforations may be smaller than the particle size of the active components of the laundry composition. In this case, granular raw material components may be used to develop the laundry composition, and fine inorganic chemicals (e.g., sodium carbonate) may be agglomerated with other components of the formulation into particles having a size larger than the largest dimension of the perforations. A sieving process may be used to screen out fine powder, leaving the appropriate particle size distribution for blending with other granular raw materials.

The thickness, porosity, polymer composition, and perforation size and pattern of the polymer film may be adjusted to increase the disintegration and dissolution rates of the polymer film. In some embodiments, a disintegrant may be added to laundry composition to increase the rate of disintegration and facilitate full dissolution of the polymer film in the laundry washing solution. Disintegrants may be particularly effective in promoting increase disintegration and dissolution rates of the polymer film in cold temperature laundry washing solution conditions. Increasing the rate at which the polymer film disintegrates and dissolves into the laundry washing solution, which facilitates quicker introduction of the active components of the laundry composition to the laundry washing solution.

In some embodiments, polymer film may be formed into a pouch 12 having a single compartment into which all of the laundry composition is positioned. In other embodiments, the pouch may have a plurality of compartments. In some embodiments, dividers may separate each of the plurality of compartments from one another and may be made from the polymer film. In these multiple-compartment embodiments, one or more active components (i.e., the enzymes, oxidizing composition, surfactants, alkaline compounds, detergent builders, strong metal ion chelants, or detersive polymers previously described or other active components) may be maintained separate from the other components of the laundry composition and added to one of the plurality of compartments, which is separated from the other compartments. In embodiments, each of the plurality of compartments of a multi-compartment pouch may contain a different composition.

Another aspect of this application is a novel manufacturing method, which uses a multi-step process to minimize material costs and maximize powder bulk density. The surfactants and certain other components of the laundry composition are typically sold in bulk as liquids. The laundry composition includes a substantial amount of these surfactants and other liquid components relative to the other solid components (i.e., granulated or powdered components), and a single step blending process cannot adequately combine these quantities of liquid surfactants with the other solid active components in an effective manner and produce a high density powder having a high bulk density. Surfactants that are normally sold as liquids (e.g., NaDBSA, alkyl sulfates, and/or alkyl ether sulfates) may be spray dried into solid powders. However, spray dried versions of these surfactants are expensive and typically have a much lower bulk density. In the method disclosed herein, bulk liquid and solid active components, such as absorptive sodium carbonate, zeolite, sulfonic acid liquid, and bulk alcohol ethoxylate liquids are combined on a large, efficient scale of operation to create powder intermediates containing reaction products of neutral surfactants (e.g., NaDBSA, alkyl sulfates, and alkyl ether sulfates), which may then be included in the powder laundry composition.

In embodiments, the method for making the laundry composition may include a first step of combining one or more liquid active ingredients with one or more solid active ingredients to form a powder intermediate. The method may also include a second step of blending the powder intermediate with one or more other solid active components to produce the laundry composition. A dense concentrated base powder referred to herein as a powder intermediate may be obtained by applying a fine pressurized spray of a liquid active component onto one or more high absorptive solid active components of the laundry composition. In a non-limiting example, a liquid surfactant, such as dodecyl benzene sulfonic acid for example, may be sprayed onto highly absorptive sodium carbonate solid/powder in a rotary, pan, or Schugi agglomerator or similar apparatus. The result is the formation of a surfactant salt (e.g., sodium dodecyl benzene sulfonate (NaDBSA)) on the sodium carbonate. The resulting powder intermediate has a substantially greater bulk density than spray dried versions of the surfactant or other solid active components. For the non-limiting example previously described, by maximizing the use of liquid dodecylbenzene sulfonic acid up to the absorption capacity of the sodium carbonate, an improvement in bulk density of at least 60 g/L or greater can be obtained relative to a dry surfactant blending approach. If the amount of surfactant is greater than the absorption capacity of the solid active components, additional powder or granular surfactants, such as spray dried versions of dodecyl benzene sulfonate, may be added as a dry raw material to make up the difference in the laundry composition.

In another non-limiting example, in situ formation of sodium alkyl ether sulfate can be achieved by premixing an alcohol ethoxylate or mixtures of alcohol ethoxylates (e.g., Neodol® 25-3, Neodol® 25-7, or Neodol® 25-9 alcohol ethoxylates manufactured by Shell Chemicals) with sulfuric acid at a specific ratio using a sulfuric acid molar excess, allowing the alcohol ethoxylated sulfuric acid to form, and then spraying the acidified ethoxylated alcohols onto sodium carbonate in either a rotary, pan, or Schugi agglomerator or similar apparatus. For this second non-limiting example, the process conversion to the neutral surfactants is about 50% efficient and the remaining nonionic surfactants become a useful part of the composition.

In addition to the sodium carbonate, zeolites (e.g., Zeolite A) and/or layered silicates may be used to absorb additional liquids, in a separate premix, or in the same mix vessel used for the in-situ surfactant formation, after all residual acid from the former step is neutralized. Only dry form sodium silicates would be used if zeolites or other insoluble materials are involved, so as to prevent large insoluble formation.

The method disclosed herein may further include an additional densification of the powder intermediate. In embodiments, densification of the powder intermediate may be performed prior to blending the powder intermediate with the enzymes, oxidizing composition, or other solid active components. Densification may include grinding, chopping, or grind and chopping the powder intermediate using a mixer with a high shear chopping device.

Not all of the total required surfactant may be incorporated via the methods described above, so it may be necessary to add additional alcohol ethoxylate or alkoxylate liquid at some stage in the process and also powder or granular versions of the anionic surfactants—NaDBSA, alkyl sulfate, alkyl ether sulfate and MES. Optionally, to aid in nonionic absorption, burkeite ($Na_6(CO_3)(SO_4)_2$) crystals may be formed in a spray tower with carbonate, sulfate and sodium polyacrylate. However, this approach involves dilution of the product chemistry with non-performing substances. Additionally, if a spray tower is used, a separate densification process may be employed to increase the bulk density of the laundry composition.

In some embodiments, the method may include conditioning or drying the powder intermediate to reduce the moisture. For example, once the surfactants and other liquid active components are adsorbed onto the solid active components, the powder intermediate may be conditioned and/or dried to reduce the moisture content of the powder intermediate. Once the powder intermediate is conditioned and/or dried, the other active ingredients may be added to the powder intermediate in a mixer. The dry mixing may be performed using a gentle mixer, such as a Forberg mixer or a double cone mixer for example, to minimize attrition and protect the coating shells of the encapsulated sodium percarbonate and enzymes that are added. Minimizing the mechanical impact and abrasion on the laundry composition aids in preserving the integrity of the coatings applied to encapsulated components, which in turn improves the stability and performance of the laundry composition. In some embodiments, the method may further include agglomerating the powder of the laundry composition to increase the average particle size of the powder laundry composition. Increasing the average particle size may reduce or prevent loss of powder through the perforations in embodiments in which a perforated polymer film is used to encapsulate the laundry composition. In some embodiments, the method may further include sieving the laundry composition to remove small particles from the powder to reduce or prevent loss of the powder laundry composition encapsulated by perforated polymer films.

In some embodiments, the method may further include encapsulating the laundry composition in the polymer film. The powder laundry composition may be conveyed to a filling machine in a manner involving the least amount of mechanical attrition.

A method of using the unit dose laundry composition includes adding the unit dose laundry composition to an aqueous wash solution in the presence of one or more articles to be laundered. The aqueous wash solution may have a temperature of from 5° C. to 70° C. or from 10° C. to 60° C. The water used to make the aqueous wash solution may have an initial hardness of from 0 ppm to 450 ppm. The hardness of the water used to make the aqueous wash solution may include one or more metal ions. The method of using the unit dose laundry composition may also include one or more of agitating or mixing the aqueous laundry washing solution, removing the laundry articles from the aqueous laundry washing solution, or rinsing the laundry articles.

EXAMPLES

The following examples illustrate one or more additional features of the present disclosure described previously. It should be understood that these examples are not intended to limit the scope of the disclosure or the appended claims in any manner.

Example 1

Preparation of the Unit Dose Laundry Composition

To prepare the unit dose laundry composition of Example 1, a powder intermediate was first prepared according to the following method. Solid sodium carbonate in an amount equal to 30.85 wt. % per unit weight of the laundry composition was added to mixing bowl in the lab. The sodium carbonate was FMC® Grade 100 sodium carbonate, anhydrous manufactured by FMC Corporation. 5.00 wt. % of liquid alkyl benzene sulfonic acid at 50° C. was then sprayed on the sodium carbonate in the agglomerator and mixed manually for 5 minutes. The alkyl benzene sulfonic acid was BIO-SOFT® S101 linear alkylbenzene sulfonic acid manufactured by the Stepan Company and was 97% active with an alkyl group having from 10 to 16 carbon atoms. 2.00 wt. % of an alcohol ethoxylate and 0.30 wt. % of a silicone antifoam dispersion (defoamer) additive were manually premixed in another vessel. The alcohol ethoxylate was NEODOL® 25-7 alcohol ethoxylate manufactured by Shell Chemicals, an affiliate of Shell Global, and comprised a fatty alcohol having 12 to 15 carbon atoms ethoxylated with 7 moles of ethylene oxide. The silicone antifoam dispersion additive used was DOW CORNING® AF8014 silicone antifoam dispersion manufactured by Dow Corning Corporation, Midland, Mich.

The premixed solution of the alcohol ethoxylate and silicone antifoam dispersion, at a temperature of 50° C., was then sprayed onto the sodium carbonate solid with continued manual mixing. Then, 2.00 wt. % of pentasodium diethylene triaminepentaacetate (chelant) at a temperature of 25° C., 1.50 wt. % of a heptasodium salt solution of diethylenetriamine penta (methylene phosphonic acid) (chelant) at a temperature of 25° C., and 1.5 wt. % of alkoxylated polyethyleneimine polymer (detersive polymer) at a temperature of 25° C. were sprayed onto the sodium carbonate with continued mixing. The pentasodium diethylene triaminepentaacetate chelant used was VERSENEX™ 80 DTPA-based chelating agent (40% active) manufactured by the Dow Chemical Company. The heptasodium salt solution of diethylenetriamine penta (methylene phosphonic acid) used was DEQUEST® 2066 chelating agent (32% active) manufactured by Italmatch Chemicals, Genoa, Italy. The alkoxylated polyethyleneimine polymer used was SOKALAN® HP-20 detersive polymer (75% active) manufactured by BASF.

The sodium carbonate having the liquid active components absorbed thereon was removed from the agglomerator and dried for 15 minutes at a temperature of 50° C. to produce the powder intermediate having the above described active ingredients. The drying step removed 1.25 wt. % water from the powder intermediate. The composition of the powder intermediate is subsequently provided in Table 1, which includes the weight percent of each component in the powder intermediate as well as the weight percent of each component based on the total weight of the final laundry composition.

TABLE 1

Composition of the Powder Intermediate of Example 1

| Component | Weight Percent in the Powder Intermediate | Final Weight Percent in the Laundry Composition |
|---|---|---|
| sodium carbonate | 73.63 | 30.85 |
| BIO-SOFT ® S101 linear alkylbenzene sulfonic acid (97% active) | 11.93 | 5.00 |
| NEODOL ® 25-7 alcohol ethoxylate | 4.77 | 2.00 |
| DOW CORNING ® AF8014 silicone antifoam dispersion | 0.72 | 0.30 |
| VERSENEX ™ 80 DTPA-based chelating agent (40% active) | 4.77 | 2.00 |
| DEQUEST ® 2066 chelating agent (32% active) | 3.58 | 1.50 |
| SOKALAN ® HP-20 detersive polymer (75% active) | 3.58 | 1.50 |
| Water removed in the drying step | −2.98 | −1.25 |
| Total | 100 | 41.90 |

An amount of the powder intermediate of 41.90 wt. % (i.e., 43.15 wt. % ingredients added based on the total weight of the unit dose laundry composition minus the 1.25 wt. % water removed in the drying step) was added to a mixing vessel. The solid active components subsequently listed in Table 2 were then added to the powder intermediate in the mixing vessel and manually mixed to form the laundry composition. The weight percent values provided in Table 2 are based on the total weight of the laundry composition. The laundry composition had a bulk density of 700 g/L.

TABLE 2

Formulation of Dry Solid Components of the Laundry Composition of Example 1

| Active Component | Trade Name | Manufacturer | Wt. % |
|---|---|---|---|
| Powder intermediate | See Table 1 | See Table 1 | 41.90 |
| sodium dodecyl benzene sulfonate (dried, 92% active) | NACCONOL ® 90G anionic surfactant | Stepan Company | 15.00 |
| sodium fatty acid methyl ester sulfonate (dried, 77% active) | MIZULAN ® P-82LC anionic surfactant | Lion Corporation, Tokyo, JP | 5.00 |
| sodium lauryl sulfate (95-99% active) | TEXAPON ® K-12-G | BASF | 3.00 |
| maleic acid-acrylic acid copolymer, sodium salt (92% active) | SOKALAN ® CP45 | BASF | 3.00 |
| sodium carboxymethyl cellulose (minimum 70% active, D.S. 0.4-0.6) | GELYCEL ® 2-70 | Quimica Amtex y Amtex Chemicals, LLC | 1.00 |
| C.I. fluorescent brightener 71 | CAS 16090-02-1 | Ciba Geigy | 0.10 |
| sodium percarbonate (coated, >95% active) | PROVOX C ® | OCI Chemical Corporation | 13.00 |
| sodium nonanoyloxybenzenesulfonate (81% active) (NOBS) | None | Future Fuels Chemical Company | 5.00 |
| Tetraacetylethylenediamine (92% active) (TAED) | MIKON ™ ATC bleach activator | Lubrizol Corporation | 5.00 |
| protease enzyme (coated granules) | SAVINASE ® EVITY ® 12T | Novozymes | 3.00 |
| amylase enzyme (coated granules) | STAINZYME ® plus EVITY ® 12 T | Novozymes | 2.00 |
| lipase enzyme (coated granules) | LIPEX ® EVITY ® 100T | Novozymes | 2.00 |
| mannanase enzyme (coated granules) | MANNAWAY ® EVITY ® 4.0T | Novozymes | 1.00 |
| Total | | | 100.00 |

After preparing the laundry composition, an amount of the laundry composition were then encapsulated in a polymer film using a Model PVS rotary filler machine manufactured by Green Sustainable Packaging to prepare the unit dose laundry composition of Example 1. The polymer film used to encapsulate the laundry composition was MONOSOL® M8630 polyvinyl alcohol based thermoplastic film manufactured by Kuraray Co., Ltd. The gross weight of each unit dose of the unit dose laundry compositions was 22.8 grams.

Example 2

Evaluation of the Unit Dose Laundry Composition of Example 1

Test fabric samples were obtained and prepared for evaluating the performance of the unit dose laundry composition of Example 1. Soiled fabric samples were obtained from Scientific Services S/D, Inc. of Sparrowbush, N.Y. The fabric samples included cotton and polyester/cotton swatches soiled with dust sebum, clay, grass, ball point ink, and make-up. Additional EMPA standard soiled fabric samples were obtained from Testfabrics, Inc. of West Pittston, Pa. The fabric samples provided by Testfabrics included EMPA 101 (cotton fabric soiled with carbon black and olive oil), EMPA 104 (65% polyester/35% cotton fabric (CPDP) soiled with carbon black and olive oil), EMPA 112 (cotton fabric soiled with cocoa), EMPA 116 (cotton fabric soiled with blood, milk, and ink), and EMPA 117 (CPDP soiled with blood, milk, and ink). Additional soiled fabric samples were prepared bench-side (bench samples) by soiling clean cotton fabric swatches obtained from Scientific Services with coffee, grape juice, red wine and spaghetti sauce. The reflectance of each soiled fabric sample was measured with a model 577 Reflectometer manufactured by Photovolt. The reflectance of each soiled fabric sample was measured using a green filter. The reflectance of each of the soiled fabric samples was measured before commencing the test washes.

The soiled fabric samples were then washed with one dose (22.8 grams) of the unit dose laundry composition prepared in Example 1 to evaluate the performance of the unit dose laundry composition. Three samples of each soil/fabric combination were added to a test load. The water used for each test load was adjusted to a hardness level of 150 ppm using concentrates of magnesium chloride and calcium chloride, which were added in amounts equivalent to a molar ratio of magnesium ions to calcium ions of 1:2. The test loads were run in a Model No. GTW330ASK0WW laundry washing machine manufactured by General Electric. Each test load was performed with 15 total gallons of water, which corresponds to the medium wash load setting for the washing machine. A single dose/packet of the unit dose laundry composition was added to each test load. The test loads were run at 90° F.+/−2° F. (−32° C.). The normal/regular wash cycle, which corresponds to a 12 minute wash, was selected for each of the test loads. After each wash cycle was completed, the test samples were pressed dry using the permanent press setting.

The reflectance of each of the press-dried fabric samples was then measured using the Reflectometer previously described. The soil removal percentage was then computed from the reflectance values for each soiled fabric sample. The soil removal percentages for the three samples of each type of soiled fabric were averaged together into an average soil removal percentage for each type of soiled fabric. The higher the average soil removal percentage, the better the performance of the unit dose laundry composition in removing soil from the soiled fabric. The average soil removal percentages for each type of soiled fabric of the test samples of Example 2 are provided in Table 3. The overall soil removal total is the sum of the average soil removal percentages for all of the soiled fabric types of Example 2 and provides an indication of the overall performance of the unit dose laundry composition across a broad range of soiled fabric types.

TABLE 3

Evaluation of Test Samples of Example 2 Washed with the Unit Dose Laundry Composition of Example 1

| Wash Temperature (° C.) Soil | Substrate | 32 (90° F.) Soil Removal (%) |
|---|---|---|
| Ball Point Ink | Cotton | 23.5 |
| Clay | Cotton | 39.8 |
| Coffee | Cotton | 43.7 |
| Dust Sebum | Cotton | 39.9 |
| EMPA 101 | Cotton | 11.5 |
| EMPA 104 | CPDP | 6.9 |
| EMPA 112 | Cotton | 37.2 |
| EMPA 116 | Cotton | 24.7 |
| EMPA 117 | CPDP | 17.4 |
| Grape Juice | Cotton | 68.1 |
| Grass | Cotton | 75.7 |
| Make-Up | Cotton | 35.3 |
| Red Wine | Cotton | 36.1 |
| Spaghetti | Cotton | 80.2 |
| Tea | Cotton | 4.4 |
| Overall Soil Removal Total | | 544.4 |

Comparative Example 3

Evaluation of a Market-Leading Liquid Laundry Unit Dose

As a comparison, soiled fabric samples were used to evaluate the performance of a premium market-leading multiple-compartment liquid laundry unit dose. The premium market-leading liquid laundry unit doses used in Comparative Example 3 were TIDE® PODS® liquid laundry unit dose packets manufactured and marketed by the Proctor and Gamble Company, Cincinnati, Ohio TIDE® PODS®, which include detergents, stain remover and brighteners segregated into multiple compartments of the unit dose, are considered to be the market leader in premium multiple-compartment liquid laundry unit doses in washing performance (i.e., soil removal). One package of the premium market-leading liquid laundry unit doses containing 72 laundry unit dose packets (lot number 6235172700 7710:48) was purchased on Sep. 29, 2016 from Meijer in Toledo, Ohio. The gross weight of each unit dose of the premium market-leading liquid laundry unit dose was measured to be 25.9 grams. Three samples of each type of soiled fabric were obtained or prepared as previously described in Example 2.

Each of the soiled fabric samples of Comparative Example 3 were measured for reflectance, and then washed in the presence of the premium market-leading liquid laundry unit dose, dried, and re-measured for reflectance according to the methods described above in Example 2. The test washes were performed at 90° F.+/−2° F. (−32° C.). The soil removal percentage for each soiled fabric sample of Comparative Example 3 was computed from the reflectance values. The soil removal percentage for the three replicates of each type of soiled fabric were then averaged together to get an average soil removal percentage for each type of soiled fabric. The higher the average soil removal percentage, the better the soil removal performance of the premium market-leading liquid laundry unit dose at removing that type of soil. The values for the average soil removal percentage for each type of soiled fabric of Comparative Example 3 at each temperature are subsequently provided in Table 4.

TABLE 4

Performance of the Premium Market-Leading Liquid Laundry Unit Dose of Comparative Example 3
Premium Market-Leading Liquid Laundry Unit Dose of Comparative Example 3

| Wash Temperature (° C.) Soil | Substrate | 32 (90° F.) Soil Removal (%) |
|---|---|---|
| Ball Point Ink | Cotton | 14.7 |
| Clay | Cotton | 48.5 |
| Coffee | Cotton | 54.4 |
| Dust Sebum | Cotton | 49.2 |
| EMPA 101 | Cotton | 9.3 |
| EMPA 104 | CPDP | 8.7 |
| EMPA 112 | Cotton | 30.3 |
| EMPA 116 | Cotton | 26.8 |
| EMPA 117 | CPDP | 26.7 |
| Grape Juice | Cotton | 66.7 |
| Grass | Cotton | 63.9 |
| Make-Up | Cotton | 59.6 |
| Red Wine | Cotton | 41.4 |
| Spaghetti | Cotton | 70.5 |
| Tea | Cotton | −0.2 |
| Overall Soil Removal Total | | 570.5 |

Example 4

Comparison of the Unit Dose Laundry Composition of Examples 1 and 2 to the Premium Market-Leading Liquid Laundry Unit Dose of Comparative Example 3

The following Table 5 includes the evaluation data of Example 2 for soiled fabric samples washed with the unit dose laundry composition of Example 1 at 90° F. compared to the evaluation data of Comparative Example 3 for soiled fabric samples washed with the premium market-leading liquid laundry unit dose at 90° F. Table 5 also includes the least significant difference calculated at a 95% confidence level (LSD-95) for each type of soiled fabric sample based on the results of the testing data for the test samples of Example 2 and Comparative Example 3. A description and general equations for calculating the LSD-95 for a data set can be found in Lynne J. Williams & Herve Abdi, *Fisher's Least Significant Difference (LSD) Test, Encyclopedia of Research Design*. In Neil Salkind, SAGE Publishing (2010), which is incorporated by reference herein in its entirety. The LSD-95 was calculated using t=2.78 for 95% confidence and 3 samples in each data set being compared. In Table 5 below, the difference between the average soil removal percentage of Example 2 and the average soil removal percentage of Comparative Example 3 for each type of soiled fabric is calculated. If the absolute value of the difference between average soil removal percentage for Example 2 and average soil removal percentage for Comparative Example 3 for a type of soiled fabric is greater than the LSD-95, then the difference between the average soil removal percentages is considered a statistically significant difference. Likewise, if the absolute value of the difference between Example 2 and Comparative Example 3 for a type of soiled fabric is less than the LSD-95, then the difference between the average soil removal percentages is considered to be statistically insignificant and the performance is considered to be equivalent.

TABLE 5

Comparison of the Performance of the Unit Dose Laundry Composition of Examples 1 and 2 to the Premium Market-Leading Liquid Laundry Unit Dose of Comparative Example 3 at the Wash Temperature of 90° F. (32° C.)

| | Samples | | | |
|---|---|---|---|---|
| | Comparative Example 3 Composition | Example 2 Composition | | |
| Soil (substrate) | Premium market-leading liquid laundry unit dose Soil Removal (%) | Unit dose laundry composition of Example 1 Soil Removal (%) | LSD-95 | Difference |
| Ball Point Ink (cotton) | 14.7 | 23.5 | 2.4 | 8.8 |
| Clay (cotton) | 48.5 | 39.8 | 3.0 | −8.7 |
| Coffee (cotton) | 54.4 | 43.7 | 4.4 | −10.7 |
| Dust Sebum (cotton) | 49.2 | 39.9 | 4.9 | −9.3 |
| EMPA 101 (cotton) | 9.3 | 11.5 | 2.3 | 2.2 |
| EMPA 104 (CPDP) | 8.7 | 6.9 | 2.0 | −1.8 |
| EMPA 112 (cotton) | 30.3 | 37.2 | 7.6 | 6.9 |
| EMPA 116 (cotton) | 26.8 | 24.7 | 2.8 | −2.1 |
| EMPA 117 (CPDP) | 26.7 | 17.4 | 3.7 | −9.3 |
| Grape Juice (cotton) | 66.7 | 68.1 | 3.0 | 1.4 |
| Grass (cotton) | 63.9 | 75.7 | 12.2 | 11.8 |
| Make-Up (cotton) | 59.6 | 35.3 | 6.7 | −24.3 |
| Red Wine (cotton) | 41.4 | 36.1 | 2.7 | −5.3 |
| Spaghetti (cotton) | 70.5 | 80.2 | 7.6 | 9.7 |
| Tea (cotton) | −0.2 | 4.4 | 8.3 | 4.6 |
| Total Soil Removal | 570.5 | 544.4 | | |

As shown in Table 5, at a wash temperature of 90° F., the unit dose laundry composition of Example 1 exhibited a total soil removal that was 95.4% of the total soil removal measured for the premium market-leading liquid laundry unit dose of Comparative Example 3. The overall soil removal performance of the unit dose laundry composition of Example 1, as shown by the data in Example 2, was therefore comparable to the premium market-leading liquid laundry unit dose of Comparative Example 3. With certain types of soil stains, the unit dose laundry composition of Example 1 outperformed the premium market-leading liquid laundry unit dose of Comparative Example 3. In particular, the unit dose laundry composition of example 1 performed better than the premium market-leading liquid laundry composition at removing ball point ink, grass, spaghetti, and tea, which may be at least partially attributable to the inclusion of the oxidation composition (i.e., the oxidizing agent and bleaching activators) in the unit dose laundry composition. Similar oxidation compositions were not present in the premium market-leading liquid laundry unit dose of Comparable Example 3.

Additionally, the amount of the laundry composition in the unit dose laundry composition of Example 1 which was used in the evaluation of soiled fabric samples in Example 2 was only 22.8 grams which is only 88% of the weight (25.9 grams) of the premium market-leading liquid laundry unit dose used in Comparable Example 3. Therefore, the unit dose laundry composition of Example 1 achieved comparable soil removal performance to the premium market-leading liquid laundry unit dose with only 88% by weight of the composition. Thus, a lesser quantity of the laundry composition in the unit dose laundry composition of Example 1 is needed compared to the commercially available liquid laundry unit dose of Comparable Example 3 to achieve comparable soil removal performance. The unit dose laundry composition of Example 1 may provide the additional benefits of soil removal through oxidation, increased biocidal activity, and odor reduction that are not provided by the premium market-leading liquid laundry unit dose of Example 3. The unit dose laundry composition of Example 1 was also formulated as a single compartment unit dose, making them more cost effective to produce than the multiple-compartments of the premium market-leading multiple compartment liquid laundry unit dose.

For the purposes of defining the present technology, the transitional phrase "consisting of" may be introduced in the claims as a closed preamble term limiting the scope of the claims to the recited components or steps and any naturally occurring impurities. For the purposes of defining the present technology, the transitional phrase "consisting essentially of" may be introduced in the claims to limit the scope of one or more claims to the recited elements, components, materials, or method steps as well as any non-recited elements, components, materials, or method steps that do not materially affect the novel characteristics of the claimed subject matter. The transitional phrases "consisting of" and "consisting essentially of" may be interpreted to be subsets of the open-ended transitional phrases, such as "comprising" and "including," such that any use of an open ended phrase to introduce a recitation of a series of elements, components, materials, or steps should be interpreted to also disclose recitation of the series of elements, components, materials, or steps using the closed terms "consisting of" and "consisting essentially of." For example, the recitation of a composition "comprising" components A, B, and C should be interpreted as also disclosing a composition "consisting of" components A, B, and C as well as a composition "consisting essentially of" components A, B, and C. Any quantitative value expressed in the present application may be considered to include open-ended embodiments consistent with the transitional phrases "comprising" or "including" as well as closed or partially closed embodiments consistent with the transitional phrases "consisting of" and "consisting essentially of."

It should be understood that any two quantitative values assigned to a property may constitute a range of that property, and all combinations of ranges formed from all stated quantitative values of a given property are contemplated in this disclosure. It should be appreciated that compositional ranges of a chemical constituent in a composition or formulation should be appreciated as containing, in some embodiments, a mixture of isomers of that constituent. It should be appreciated that the examples supply compositional ranges for various compositions, and that the total amount of isomers of a particular chemical composition can constitute a range.

Having described the subject matter of the present disclosure in detail and by reference to specific embodiments, it is noted that the various details described in this disclosure should not be taken to imply that these details relate to elements that are essential components of the various embodiments described in this disclosure, even in cases where a particular element is illustrated in each of the drawings that accompany the present description. Rather, the claims appended hereto should be taken as the sole representation of the breadth of the present disclosure and the corresponding scope of the various embodiments described in this disclosure. Further, it should be apparent to those skilled in the art that various modifications and variations can be made to the described embodiments without departing from the spirit and scope of the claimed subject matter. Thus it is intended that the specification cover the modifications and variations of the various described embodiments provided such modification and variations come within the scope of the appended claims and their equivalents.

What is claimed is:

1. A unit dose laundry product consisting of:

a laundry composition consisting of:

from 1 wt. % to 10 wt. % of one or a combination of coated enzymes selected from the group consisting of protease, amylase, lipase, mannanase, pectinase, pectate lyase, and cellulase;

from 1 wt. % to 40 wt. % of a bleach composition consisting of an oxidizing agent, one or more bleach activators, and optionally a bleaching catalyst;

from 20 wt. % to 80 wt. % of one or more surfactants; and one or more than one of an alkaline compound, a detergent builder, a chelant, or a detersive polymer;

optionally one or more than one of optical brighteners, foam control agents, disintegrants, corrosion inhibitors, soil repellents, wrinkle reducer agents, fabric softeners, fragrance compounds, or colorants;

wherein the laundry composition is a powder having a bulk density of from 500 grams per liter to 1,300 grams per liter; and a polymer film encapsulating the laundry composition.

2. The unit dose laundry product of claim 1, wherein the alkaline compound, the detergent builder, the chelant, and the detersive polymer are present in the laundry composition.

3. The unit dose laundry product of claim 2, wherein:

from 5 wt. % to 50 wt. % alkaline compound is present in the laundry composition;

from 10 wt. % to 50 wt. % detergent builder is present in the laundry composition;

from 0.5 wt. % to 20 wt. % chelant is present in the laundry composition; and from 1 wt. % to 20 wt. % detersive polymer is present in the laundry composition.

4. The unit dose laundry product of claim 1, wherein the alkaline compound is present in the laundry composition in an amount of from 5 wt. % to 50 wt. %.

5. The unit dose laundry product of claim 1, wherein the detergent builder is present in the laundry composition in an amount of from 10 wt. % to 50 wt. %.

6. The unit dose laundry product of claim 1, wherein the chelant is present in the laundry composition in an amount of from 0.5 wt. % to 20 wt. %.

7. The unit dose laundry product of claim 1, wherein the detersive polymer is present in the laundry composition in an amount of from 1 wt. % to 20 wt. %.

8. The unit dose laundry product of claim 1, wherein the oxidizing agent is sodium percarbonate.

9. The unit dose laundry product of claim 1, wherein the bleach activator is sodium nonanoyloxybenzene sulfonate (NOBS).

10. The unit dose laundry product of claim 1, wherein the bleach activator is selected from the group consisting of nonanoyloxybenzene sulfonate (NOBS), tetraacetylethylenediamine (TAED), and combinations thereof.

11. The unit dose laundry product of claim 1, wherein the optical brightener, the defoamer, and the disintegrant are present in the laundry composition in amounts from 0.1 wt. % to 5 wt. %.

12. The unit dose laundry product of claim 1, wherein the coated enzymes consist of:

from 0.1 wt. % to 5 wt. % protease coated granules;

from 0.1 wt. % to 5 wt. % amylase coated granules;

from 0.1 wt. % to 5 wt. % lipase coated granules; and from 0.1 wt. % to 5 wt. % mannanase coated granules.

13. The unit dose laundry product of claim 1, wherein a total weight percent of active cleaning agents in the laundry composition is equal to or greater than 95 wt. % based on the total weight of the laundry composition.

14. The unit dose laundry product of claim 1, wherein the polymer film is a polyvinyl alcohol (PVA) film.

15. The unit dose laundry product of claim 14, wherein the polymer film is perforated.

16. The unit dose laundry product of claim 14, wherein the polymer film has a thickness of from 20 micrometers to 50 micrometers.

17. A unit dose laundry product consisting of a laundry composition encapsulated in a polymer film, the laundry composition consisting of:

from 1 wt. % to 10 wt. % of one or more coated enzymes selected from the group consisting of protease, amylase, lipase, mannanase, pectinase, pectate lyase, and cellulase;

from 1 wt. % to 40 wt. % of a bleach composition consisting of an oxidizing agent and one or more bleach activators;

from 20 wt. % to 80 wt. %72 wt. % of one or more surfactants;

from 5 wt. % to 50 wt. % of an alkaline compound;

from 10 wt. % to 50 wt. % of a detergent builder;

from 0.5 wt. % to 20 wt. % of a chelant;

from 1 wt. % to 20 wt. % of a detersive polymer; and optionally, one or more of optical brighteners, foam control agents, disintegrants, corrosion inhibitors, soil repellents, wrinkle reducer agents, fabric softeners, fragrance compounds, or colorants;

wherein the laundry composition is a powder.

18. The unit dose laundry product of claim 17, wherein the coated enzymes consist of:

from 0.1 wt. % to 5 wt. % protease coated granules based on the total weight of the laundry composition;

from 0.1 wt. % to 5 wt. % amylase coated granules based on the total weight of the laundry composition;

from 0.1 wt. % to 5 wt. % lipase coated granules based on the total weight of the laundry composition; and from 0.1 wt. % to 5 wt. % mannanase coated granules based on the total weight of the laundry composition.

19. The unit dose laundry product of claim 17, wherein the bleach activators consist of sodium nonanoyloxybenzene sulfonate (NOBS) and tetraacetylethylenediamine (TAED), wherein NOBS is present in the laundry composition in an amount of from 3 wt. % to 15 wt. % and TAED is present in the laundry composition in an amount of from 3 wt. % to 15 wt. %.

* * * * *